US011452366B1

(12) United States Patent
Gentile et al.

(10) Patent No.: US 11,452,366 B1
(45) Date of Patent: Sep. 27, 2022

(54) BRISTLE TUFT ASSEMBLY AND ASSOCIATED FABRICATION METHODS

(71) Applicant: Willo 32 SAS, Limoges (FR)

(72) Inventors: Jean-Marie de Gentile, Paris (FR); David Aurélien Barlet, Rilhac-Rancon (FR); Loïc Guérin, Razès (FR); Gisèle Caillon-Bach, Veyrac (FR)

(73) Assignee: Willo 32 SAS, Limoges (FR)

( * ) Notice: Subject to any disclaimer, the term of this patent is extended or adjusted under 35 U.S.C. 154(b) by 0 days.

(21) Appl. No.: 17/567,554

(22) Filed: Jan. 3, 2022

Related U.S. Application Data

(60) Provisional application No. 63/287,696, filed on Dec. 9, 2021.

(51) Int. Cl.
*A46B 9/06* (2006.01)
*A46B 9/04* (2006.01)

(52) U.S. Cl.
CPC ..... *A46B 9/06* (2013.01); *A46B 9/045* (2013.01); *A46B 2200/1066* (2013.01)

(58) Field of Classification Search
CPC .... A46B 9/06; A46B 9/045; A46B 2200/1066
See application file for complete search history.

(56) References Cited

U.S. PATENT DOCUMENTS

| | | | | |
|---|---|---|---|---|
| 3,771,189 | A * | 11/1973 | Horton | A46B 13/008 15/207.2 |
| 5,474,366 | A * | 12/1995 | Strutt | A46D 3/005 300/21 |
| 6,957,468 | B2 | 10/2005 | Driesen et al. | |
| 9,788,643 | B2 | 10/2017 | Ji | |
| 10,376,349 | B2 | 8/2019 | Deane et al. | |
| 2007/0006410 | A1* | 1/2007 | Kraemer | A46B 15/0012 15/167.1 |
| 2013/0334732 | A1* | 12/2013 | Kotitschke | A46D 3/00 264/243 |
| 2017/0065071 | A1* | 3/2017 | Fritsch | B29C 66/73921 |
| 2018/0289140 | A1* | 10/2018 | Dengler | A46B 3/06 |
| 2019/0350354 | A1 | 11/2019 | Watcharotone et al. | |

FOREIGN PATENT DOCUMENTS

| | | | |
|---|---|---|---|
| DE | 3920769 | A1 | 1/1991 |
| DE | 10310902 | A1 | 9/2004 |
| EP | 1328174 | B1 | 7/2012 |
| KR | 20000047327 | A | 7/2000 |
| WO | 1998035584 | A1 | 8/1998 |
| WO | 2015031097 | A1 | 3/2015 |

* cited by examiner

*Primary Examiner* — Weilun Lo
(74) *Attorney, Agent, or Firm* — Daylight Law, P.C.

(57) ABSTRACT

Bristle tuft assemblies and associated fabrication methods are disclosed. One disclosed bristle tuft assembly comprises a bristle tuft, a retention material and a support surface. The support surface is permeable to the retention material when the retention material is in a molten state. The retention material is fused into the support surface. The bristle tuft is connected to the support surface via the retention material.

30 Claims, 28 Drawing Sheets

2810

2820

BRISTLE TUFT ASSEMBLY AND ASSOCIATED FABRICATION METHODS

CROSS REFERENCE TO RELATED APPLICATIONS

This application claims the benefit of U.S. Provisional Patent Application No. 63/287,696 filed Dec. 9, 2021, which is incorporated by reference herein in its entirety for all purposes.

BACKGROUND

Toothbrushes have long been manufactured using a process known as "staple tufting." Staple tufting involves providing a bundle of filaments having a length that is approximately twice the desired bristle length, folding the bundle in half to form a bristle tuft, and securing the tuft in place in a pre-cored hole in the head of the toothbrush by inserting the tuft into the pre-cored hole with a metal staple. Staple tufting is not suitable for other forms of oral care products, such as those which use soft flexible mouthpieces, as it requires a hard surface to staple the bristle tufts onto.

Other techniques have been developed to attach bristles to a mouthpiece. For instance, it is possible to weave nylon bristles into flexible surfaces of a mouthpiece by using a mounting surface. This technique provides a way to automate the manufacturing of mouthpieces with bristles. However, it doesn't allow bristle tufts, which could provide higher cleaning efficiency than individual bristles. Additional techniques rely on using a welded joint between the bristle tufts and the surface, to attach the tufts to the surface. This specific technique provides a way to bond the bristle tufts to the carrier surface. However, it doesn't allow the use of any materials as a carrier surface. Instead, there is a need to use a transparent carrier material.

SUMMARY

This disclosure relates generally to tuft assemblies and associated fabrication methods. As used herein, a tuft assembly can include a pad made of at least one tuft attached to a support surface. A tuft can include a group of filaments or bristles, such as nylon bristles. The tuft can therefore be a bristles tuft. A support surface can include a surface to hold bristles tufts, also known as a bristle carrier and/or bristle grid. The support surface can be or be configured to be attached to any implement, for example a brush, glove, or a pad. The surface can be made using textile techniques such as weaving, knitting, stapling or the like. In specific embodiments of the invention, the support surface can be referred to as a permeable surface, in that the support surface can be permeable to a retention material via which the tufts and the support surface are connected.

This disclosure describes manufacturing processes for attaching the tufts to the support surface to form a tuft assembly (or pad, as referred to elsewhere herein). In specific embodiments of the invention, a retention material is used to connect the tufts and the support surface. The retention material can be provided at one end or base of the tuft, which will be in contact with the support surface. The other end of the tuft can be a free end, for example to provide a brushing action if used for this purpose. In specific embodiments of the invention, the retention material is the material of the tuft itself. In other embodiments, the retention material is a different material added during the manufacturing process. The retention material can be transitioned to a molten state, for example by the application of heat. The support surface can be a support surface permeable to the retention material in such molten state. In this way, the retention material can flow through the support surface when heated at a target temperature, and the support surface and tufts can be connected together via the retention material to form the tuft assembly.

Specific embodiments of the invention provide a strong and effective alternative for attaching bristles to a surface compared to known techniques (woven bristles or clamped bristle tufts). The processes described herein can be used to manufacture pads to manage the retention of the tufts, their location, and their orientation.

Specific embodiments of the invention disclose tuft assemblies intended for use in oral care appliances. However, the tuft assembly and processes described herein can be used beyond dental or oral care applications, such as for instance personal hygiene and care (e.g., toothbrush, hair brush, skin scrubber, gloves for washing dishes), pet care (e.g., brushes), cleaning instruments (e.g. at home cleaning appliances), industrial cleaning systems, powered portative tools, carpets and fabrics applications, textile filters, flow control systems using filaments (like seal skin used for skiing), construction (window sealing tape) and many more.

Specific embodiments of the invention provide soft pads lined with tufts (e.g., silicone pads with nylon tufts). These pads can provide many advantages compared to woven pads. For example, its recovery can be better and predictable, the efficiency can be increased, the comfort can be improved, and bacterial proliferation can be contained. Furthermore, the fabrication techniques of specific embodiments of the invention could be applied in an industrial way. In comparison with the traditional ways of attaching filaments to a flexible surface or rig surface, the approaches described herein can improve the ability of the filaments to remain attached to their supports while under mechanical stress such as traction, compression, bending, twisting, etc. The ability to place and orient the filaments toward a given direction with more versatility and the ability to manage the filament characteristics such as material, diameter, length, density, etc., can also be improved. Additionally, the performance of the brushing (e.g., plaque and debris removal capacity) can be better and protection against potential bacterial contamination can be increased.

In specific embodiments of the invention, a bristle tuft assembly is provided. The bristle tuft assembly comprises a bristle tuft, a retention material, and a support surface. The support surface is permeable to the retention material when the retention material is in a molten state. The retention material is fused into the support surface. The bristle tuft is connected to the support surface via the retention material.

In specific embodiments of the invention, a method for forming a bristle tuft assembly is provided. The method comprises the steps of transitioning a retention material to a molten state, permeating a support surface with the retention material, when the retention material is in the molten state, and fusing the retention material into the support surface. The retention material is fused into the support surface. A bristle tuft is connected to the support surface via the retention material. In specific embodiment of the invention, a bristle tuft assembly is provided. The bristle tuft assembly comprises a bristle tuft, a retention material on an end of the bristle tuft, and a support surface that is permeable to the retention material when the retention material is in a molten state. The retention material is fused into the support surface.

BRIEF DESCRIPTION OF THE DRAWINGS

In the Figures, like reference numbers correspond to like components unless otherwise stated.

DETAILED DESCRIPTION

The methods and systems disclosed in this section are nonlimiting embodiments of the invention, are provided for explanatory purposes only, and should not be used to constrict the full scope of the invention. It is to be understood that the disclosed embodiments may or may not overlap with each other. Thus, part of one embodiment, or specific embodiments thereof, may or may not fall within the ambit of another, or specific embodiments thereof, and vice versa. Different embodiments from different aspects may be combined or practiced separately. Many different combinations and sub-combinations of the representative embodiments shown within the broad framework of this invention, that may be apparent to those skilled in the art but not explicitly shown or described, should not be construed as precluded.

Figure 1:
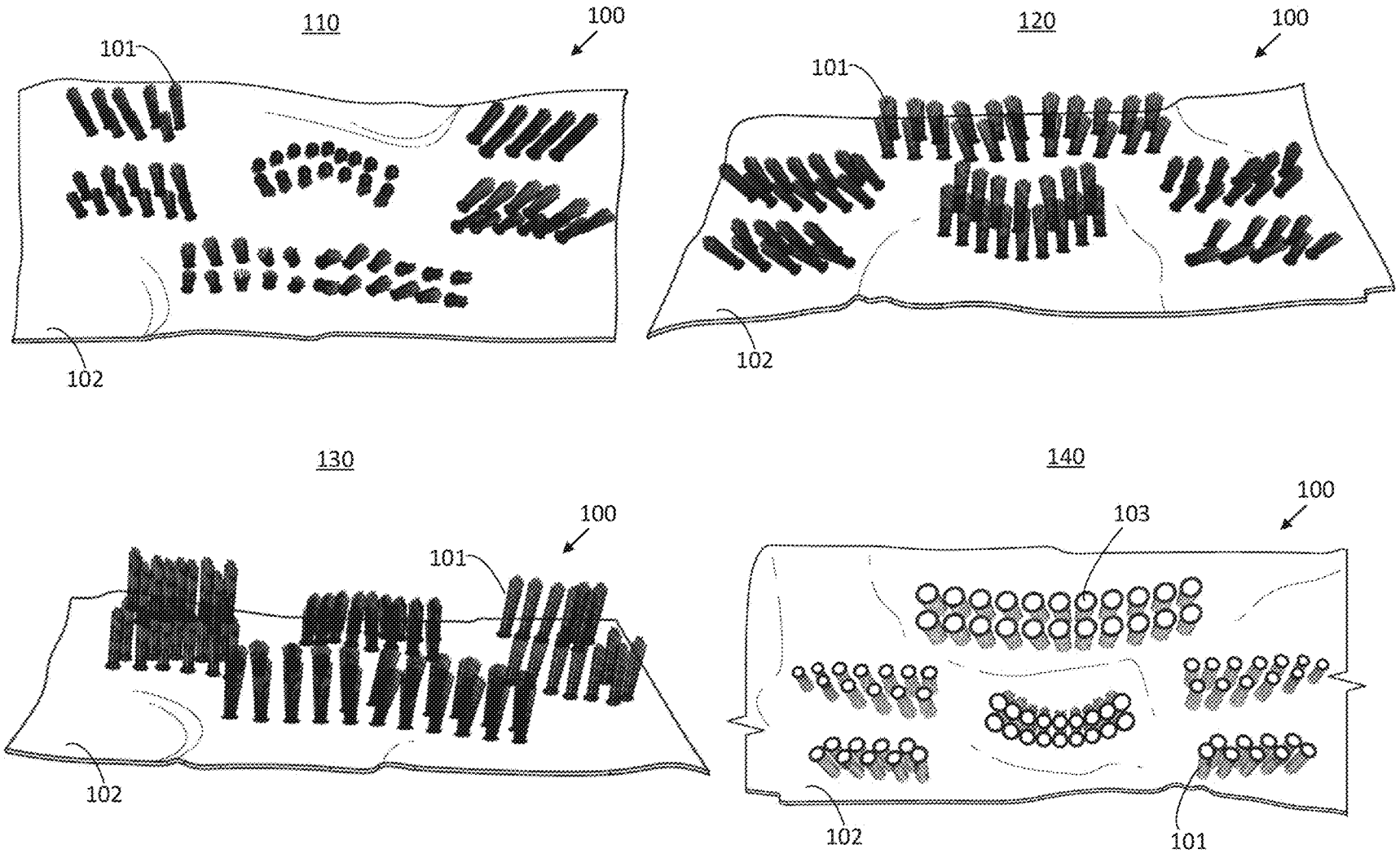
FIG. 1 illustrates an exemplary bristle tuft assembly, in accordance with specific embodiments of the invention disclosed herein.

FIG. 1 illustrates an exemplary bristle tuft assembly, in accordance with specific embodiments of the invention disclosed herein. FIG. 1 includes four views of a tuft assembly prototype 100: a top view 110, a first perspective view 120, a second perspective view 130, and a bottom view 140. The bristle tuft assembly, such as assembly 100 of FIG. 1, can include at least one bristle tuft, such as bristle tufts 101, and a support surface, such as support surface 102. The support surface 102 can be arranged to hold the bristle tufts 101. For example, the bristle tuft assembly can include a retention material. The bristle tufts 101 can be connected to the support surface 102 via the retention material.

In specific embodiments of the invention the retention material can be on one end of the bristle tuft, such as end or base 103 illustrated in back view 140. The retention material can be fused at one end of the bristle tufts and/or can be fused into the support surface. The support surface can therefore be arranged to hold the retention material and the bristle tufts. The support surface can be permeable to the retention material when the retention material is in a molten state, so that the tufts and the support surface can be fused by transitioning the material to a molten state (e.g., by applying heat) and permeating the support surface with such material.

The bristles tufts, such as bristles tufts 101, can be made of any suitable material. In specific embodiment of the invention the bristles tufts can be made of any temperature-sensitive material, such as materials able to fuse and solidify while cooling (e.g., thermoplastic and thermo-setting polymers). In specific embodiments of the invention, the filaments/bristles in the tufts can be made of polyamide, LSR silicone, TPE, TPU, ABS or other suitable materials.

In specific embodiments of the invention, in the fabrication example given previously, the bristle tufts can be made of nylon and the support surface can be a metallic grid or mesh. The fused retention can be created during a process where a heating plate melts the base of the tufts, as will be described below in more detail.

Figure 2:
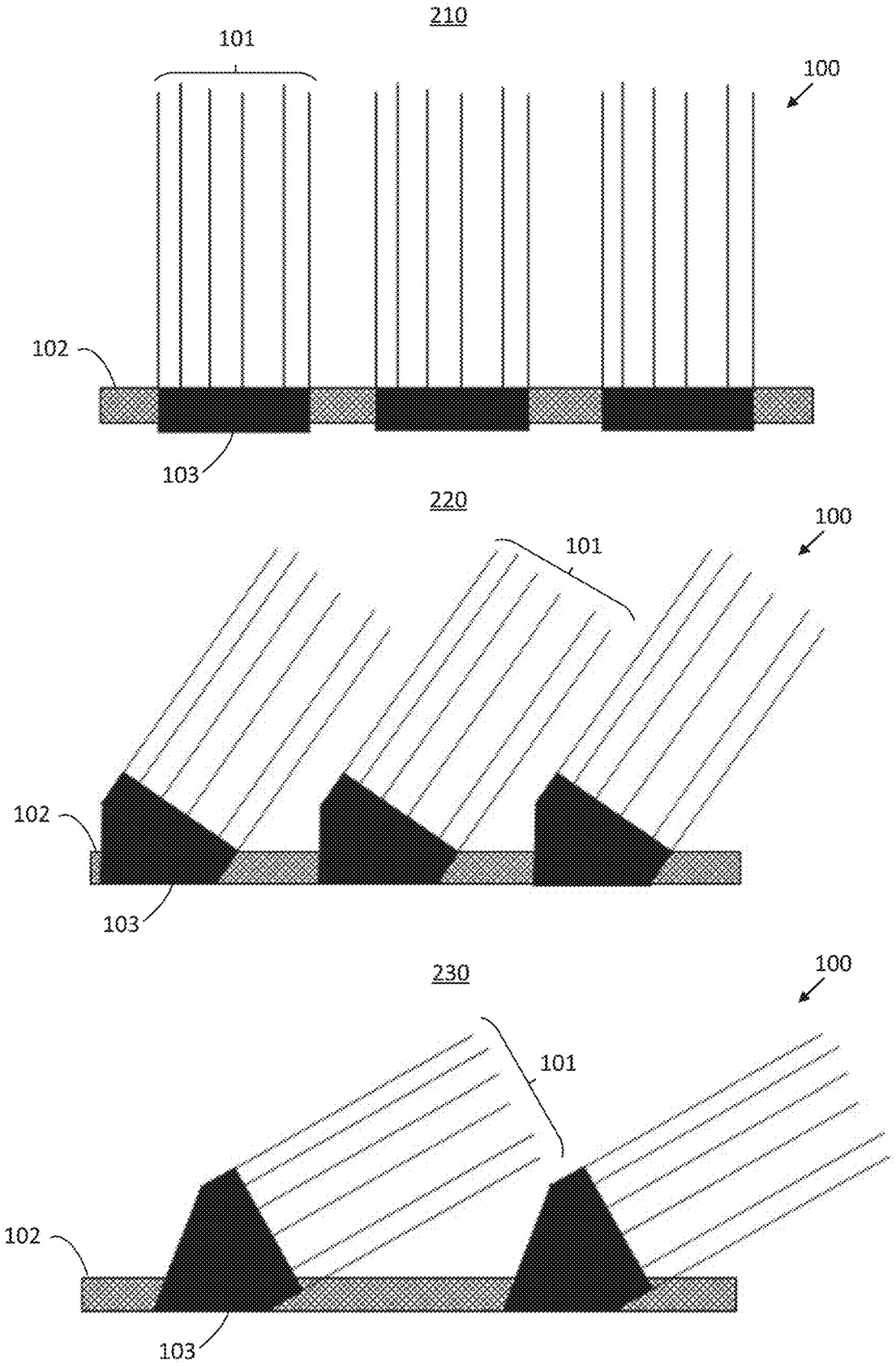
FIG. 2 illustrates various examples of tuft angulation for a bristle tuft assembly, in accordance with specific embodiments of the invention disclosed herein.

In specific embodiment of the invention, once assembled, the tufts attached to the support surface can be angulated, for example from 90° to 10°. In specific embodiments of the invention, the maximum angle could be closer to 0°. FIG. 2 illustrates various examples of tuft angulation for a bristle tuft assembly, in accordance with specific embodiments of the invention disclosed herein. View 210 illustrates a tuft angulation of around 90°. View 220 illustrates a tuft angulation of around 45°. View 230 illustrates a tuft angulation of around 30°. These and other configurations are possible for a given bristle tuft assembly. The examples in FIG. 2 illustrate bristle tuft assemblies in which all the illustrated tufts are angulated in the same direction and approximate degree. However, this is not a limitation of the invention as multiple angulations can be combined in a single assembly. The prototype of the example of FIG. 1, for example, illustrates an assembly which combines multiple tuft angulations.

Figure 3:
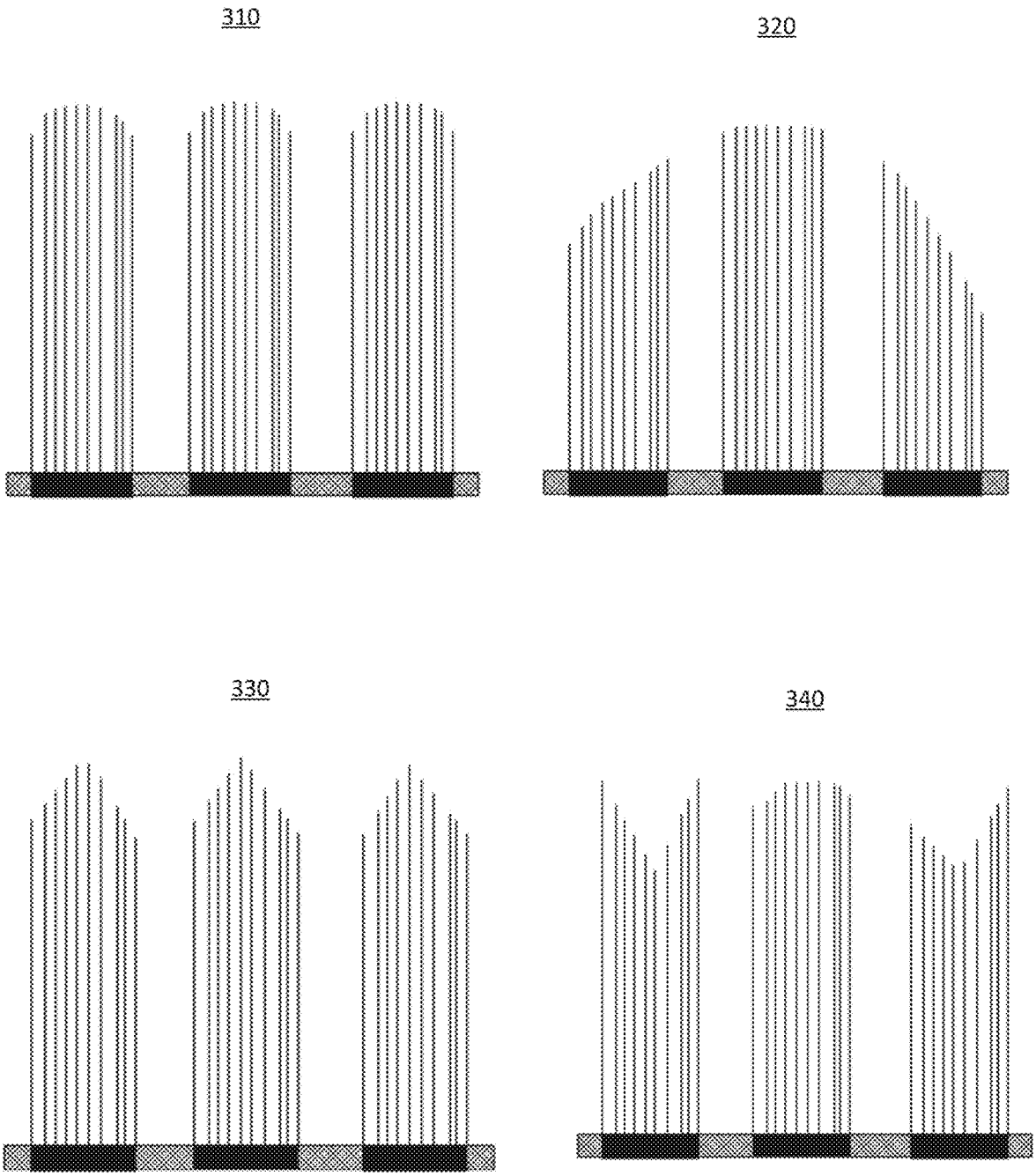
FIG. 3 illustrates examples of bristle tufts of various lengths and shapes, in accordance with specific embodiments of the invention disclosed herein.

The filaments (e.g., bristles) constituting the tufts can be of various lengths, and therefore provide various shapes to the tufts. In specific embodiments of the invention, the filaments/tufts can be regular (e.g., of the same length and shape) as illustrated in the examples of FIG. 2. In other embodiments, the filaments/tufts can be provided in various lengths and shapes. FIG. 3 illustrates examples of bristle tuft assemblies with bristle tufts of various lengths and shapes, in accordance with specific embodiments of the invention disclosed herein. View 310 illustrates a bristle tuft assembly with bristle tufts in a rounded shape. View 320 illustrates a bristle tuft assembly with bristle tufts in a wave shape. View 330 illustrates a bristle tuft assembly with bristle tufts in a tapered shape. View 340 illustrates a bristle tuft assembly with bristle tufts with irregular shapes. These and other lengths and/or shapes are possible for bristle tuft assemblies in accordance with specific embodiments of the present invention. Any of the shapes illustrated herein and/or any other shape can be combined in a single assembly. For example, in view 340 each tuft has a different shape and different filaments have different lengths. The assembly can be customized for specific uses and/or as desired by a user to provide the desired design. In this way, the length of the bristles and shape of the tufts can be selected to better suit specific needs and/or likings. The tufts can be integrated in the assembly as is. For example, if the tufts are already assembled with a specific trimming, they can be integrated in with a support surface with that specific trimming already having been conducted. Alternatively, the tufts can be trimmed once they are attached to the support surface. In specific embodiments of the invention, the differences in lengths and/or shape (e.g., by trimming the filaments) could improve the efficiency of the bristle tuft assembly. For example, these differences could improve an oral care appliance, such as a brush, at performing specific cleaning actions or other actions.

In specific embodiments of the invention, not only the length of the filaments within a tuft and from tuft to tuft across an assembly can vary, but also (or alternatively) the density can vary within a tuft and from one tuft to another across an assembly. This can be advantageous for various reasons. For example, for cleaning or brushing purposes, a denser tuft could offer greater resistance to shearing constraints while a lower density tuft will bend more easily. Other parameters within a tuft and from tuft to tuft across an assembly can also vary, such as the diameter of the filaments, the surface texture of the filaments, the coating of the filaments, etc.

Figure 4:
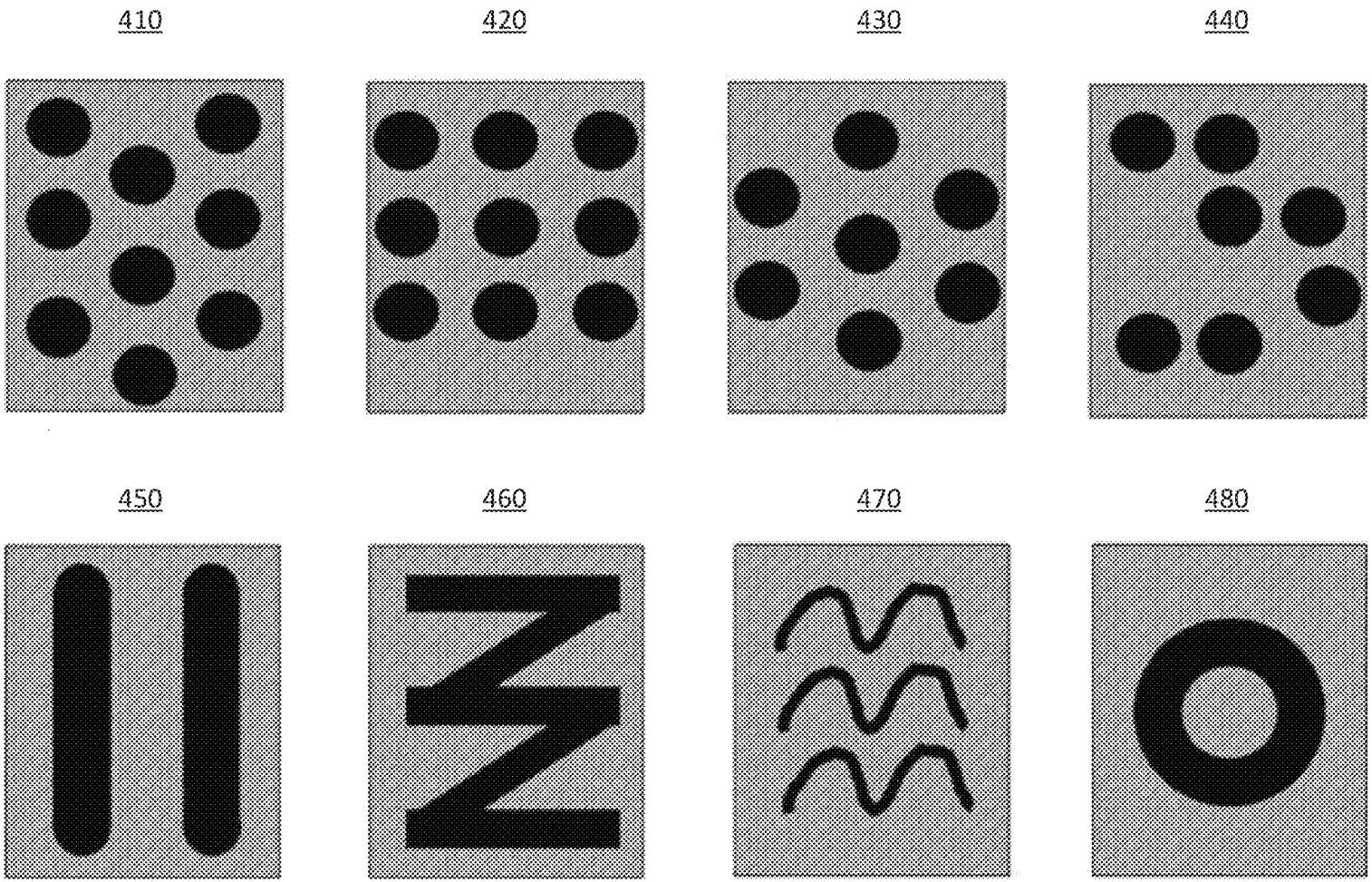
FIG. 4 illustrates various examples of possible distributions of tufts in a support surface, in accordance with specific embodiments of the invention disclosed herein.

In specific embodiments, the distribution of the tufts and their shape can be arranged on the support surface along various patterns. This distribution can either be homogeneous or not. For example, the distance between each tuft can be steady or can vary. FIG. 4 illustrates various examples of possible distributions of tufts (e.g., tuft 101) in a support surface (e.g., support surface 102). All the views in FIG. 4 are top views of the tuft assembly (e.g., tuft assembly 100). View 410 illustrates tufts distributed in alternating rows. View 420 illustrates tufts distributed in aligned rows. View 430 illustrates tufts distributed in a circle. View 440 illustrates tufts in a random distribution. View 450 illustrates oblong tufts, which can be oblong tufts individually shaped as illustrated or individual smaller tufts of any shape placed together in the support surface to provide the illustrated oblong pattern. View 460 illustrates tufts distributed in a zig zag pattern. View 470 illustrates tufts distributed in a wavy pattern. View 480 illustrates tufts distributed in a disk. The distributions illustrated in FIG. 4 are non-limiting examples of the various shapes that can be provided in specific embodiments of the invention. The shapes can be customized for specific uses and likings and depending on the appliance where the tuft assembly is going to be used.

In specific embodiments of the invention, the tufts and/or filaments are resistant to being pulled from the support surface. The pulling resistance (or pullout resistance) of a tuft or a filament can be defined as their capacity to remain attached to the support surface (e.g., a grid or a mesh) when a pulling force is applied to their free extremity. In specific embodiments of the invention, the tuft assembly can be used in oral care appliances. In specific embodiments of the invention, to meet dental standards, this resistance can be higher than a defined standard of 15 N (exerted on one tuft).

In specific embodiments of the invention, to ensure that the attachment of the tuft and filaments is strong enough to resist being pulled from the support surface, some fabrication parameters can be observed. For example, the support surface (e.g., grid) could be selected so that it is resistant enough. As another example, if the support surface is a fabric, the threads composing the mesh could be selected so that they are resistant. As another example, the support surface (e.g., grid) density can be selected so that it provides apertures of a desired size (for example to insert the tufts and/or to allow/enhance the permeability of the surface, which could be fine-tuned depending on the surface and retention material characteristics). In specific embodiments of the invention, the density can be between 2 threads/mm$^2$ to 2500 threads/mm$^2$. In this way, the apertures and material dimension can go from 10 μm to 1 mm. As another example, the permeability of the support surface (e.g., grid) can be selected so that it is good enough to let the tuft material and/or retention material flow through it (which could depend on the thread thinness and spacing). As another example, the tuft material can be selected so that it is of high quality to ensure both its resistance to traction and homogeneity of its fusion. As another example, the thickness of the fused portion of the tuft passing through the support surface (e.g., grid/mesh) as well as the shape of this portion (fused material) can be considered. These and other considerations can be considered when selecting the materials and design for a specific tuft assembly.

Figure 5:
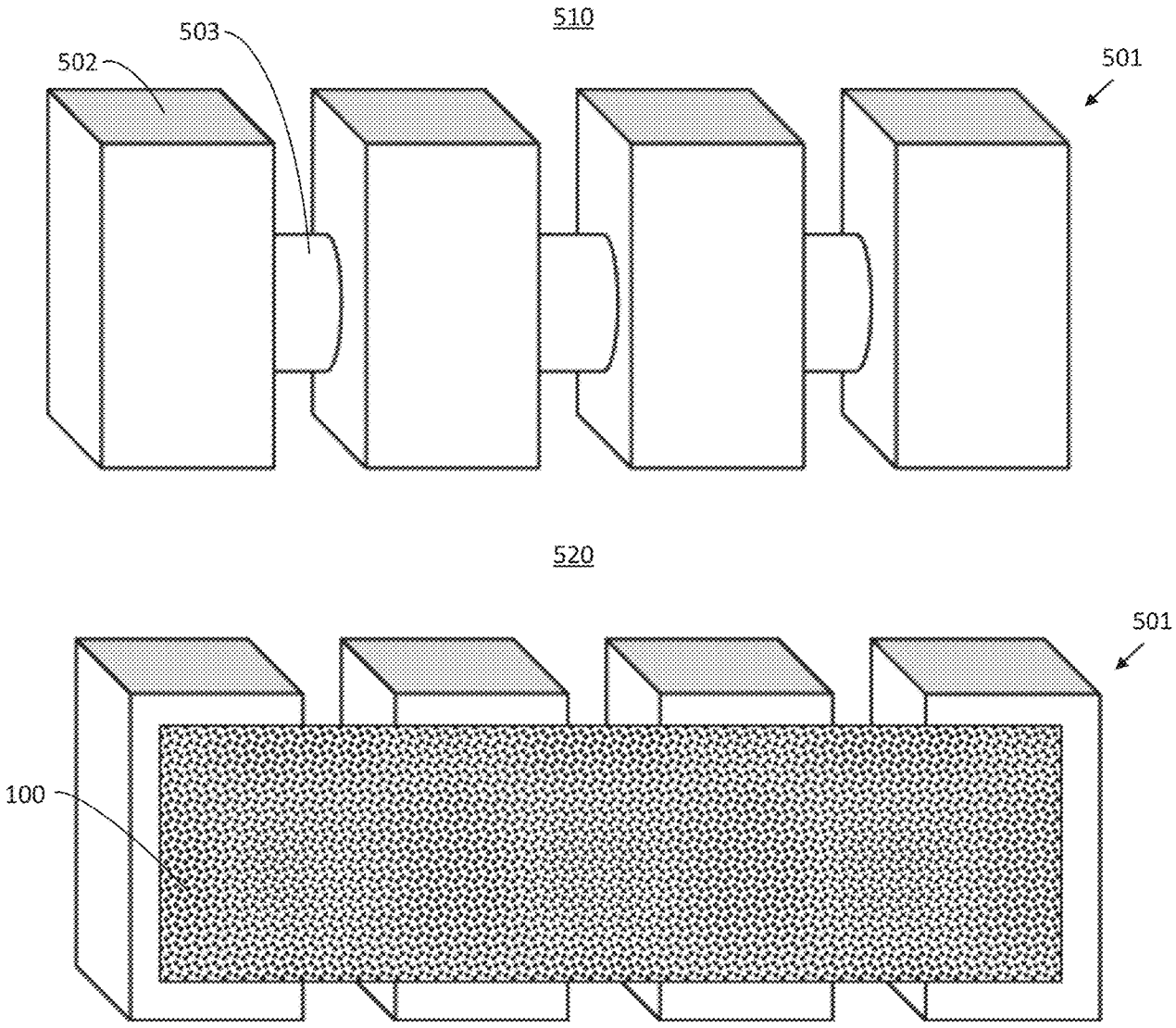
FIG. 5 illustrates an example of a tuft assembly integrated in a flexible structure, in accordance with specific embodiments of the invention disclosed herein.

The tuft assembly of specific embodiments of the invention can be elastically deformable, inelastically deformable, or rigid, either partly or completely. The term "elastically deformable" as used in this disclosure, implies that the structure is able to revert to its original size and shape after being stretched, squeezed, or twisted. In specific embodiments of the invention, the tuft assembly (or at least part of it) can be elastically deformable in that it can easily be deformed without keeping the deformation permanently if the constraints applied remain under a defined limit. In specific embodiments of the invention, the tufts assembly can be a fully elastically deformable tuft assembly. This could help integrate the tuft assembly on several different types of structure, either flexible or rigid. In this way, if the structure needs to deform elastically in any given direction, the tuft assembly once attached to the structure, does not necessarily limit its deformation. FIG. 5 illustrates an example of a tuft assembly, such as tuft assembly 100, integrated in a flexible structure 501, in accordance with specific embodiments of the invention disclosed herein. The structure 501 can either be made of an elastic material or can be an articulated assembly of rigid parts (for example parts 502 can be rigid parts joined by joints 503, which provide movement to the structure 501, as illustrated in image 510). Image 520 illustrates a one-part tuft assembly 100 integrated with the structure 501. If the tuft assembly is flexible, adding this one-part tuft assembly on this kind of structure would not necessarily limit the movement capacity of the structure. The structure 501 can be a structure of an oral care appliance or any other kind of appliance with which the tuft assembly can be integrated.

In specific embodiments of the invention, the tuft assembly can be formed to keep a certain shape under specific conditions. These conditions could vary and can include mechanical constraints, heat exposure, specific pressure, hygrometric conditions, etc. With this solution, the tuft assembly can be placed and attached or simply shaped to a structure (e.g., using vacuum forming techniques). For example, the tuft assembly can be placed on the structure and an airtight film can be added to close a sealed enclosure. Air can be aspirated from the cavity and pressure can be applied to the tuft assembly to force it to take the shape of the structure. During this process, the conditions inside the enclosure can be monitored (e.g., heat, hygrometry, pressure, etc., for example to create the desired conditions for a given outcome).

Figure 6:
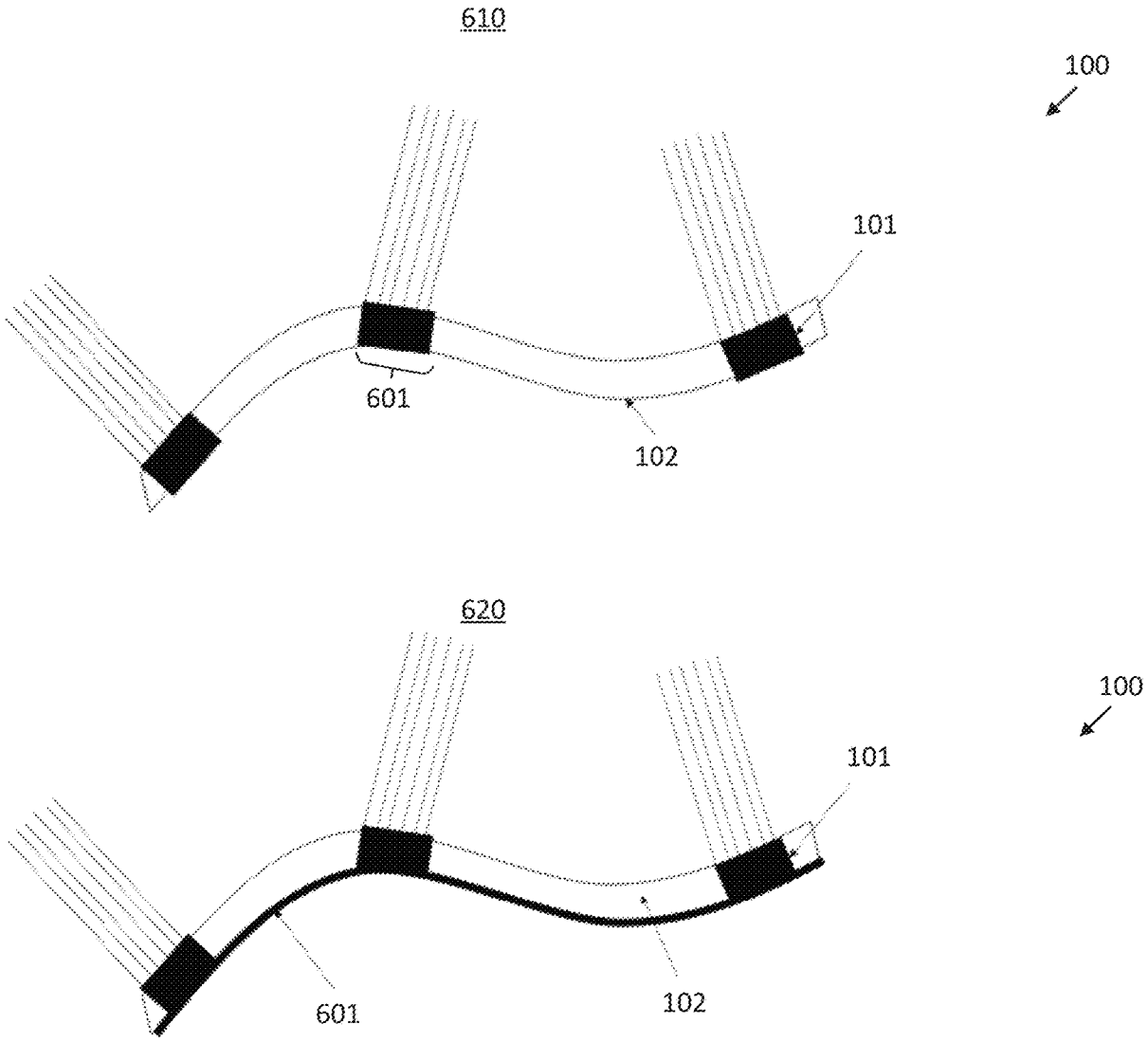
FIG. 6 illustrates examples of tuft assemblies with different configurations for the retention area, in accordance with specific embodiments of the invention disclosed herein.

For the elastically deformable application, the support surface of the tuft assembly can be elastic, meaning that it can be easily deformed (for instance by applying force manually) while having the ability to return to its original shape with no permanent deformation once the constraints disappear. The constraints can either be traction, compression, shearing, torsion, flexion, or a combination thereof. In specific embodiments of the invention, for the inclusion of the tufts and their retention area not to limit the elasticity of the tuft assembly, the retention could be made of a material that reacts elastically under the given constraints, or the area could be limited. FIG. 6 illustrates examples of tuft assemblies with different configurations for the retention area, in accordance with specific embodiments of the invention disclosed herein. The first configuration 610 shows retention areas 601 (the areas that join the tufts (e.g., 101) with the support surface (e.g., 102)) which are limited in size. If the retention areas are rigid, they could act as rigid bodies being articulated in the flexible support surface 102. The second configuration 620 shows a retention area 601 that can connect all the bases of the tufts together. The retention area can be made of an elastic material and not limit the overall elasticity of the tuft assembly. In specific embodiments of the invention, the connecting material (or retention material) can have a Young Modulus (linear elongation versus pressure applied) lower than the support surface. This material can directly come from the fusion of the bases of the tufts or can be added during the fusion process, as will be described below in more detail.

Figure 7:
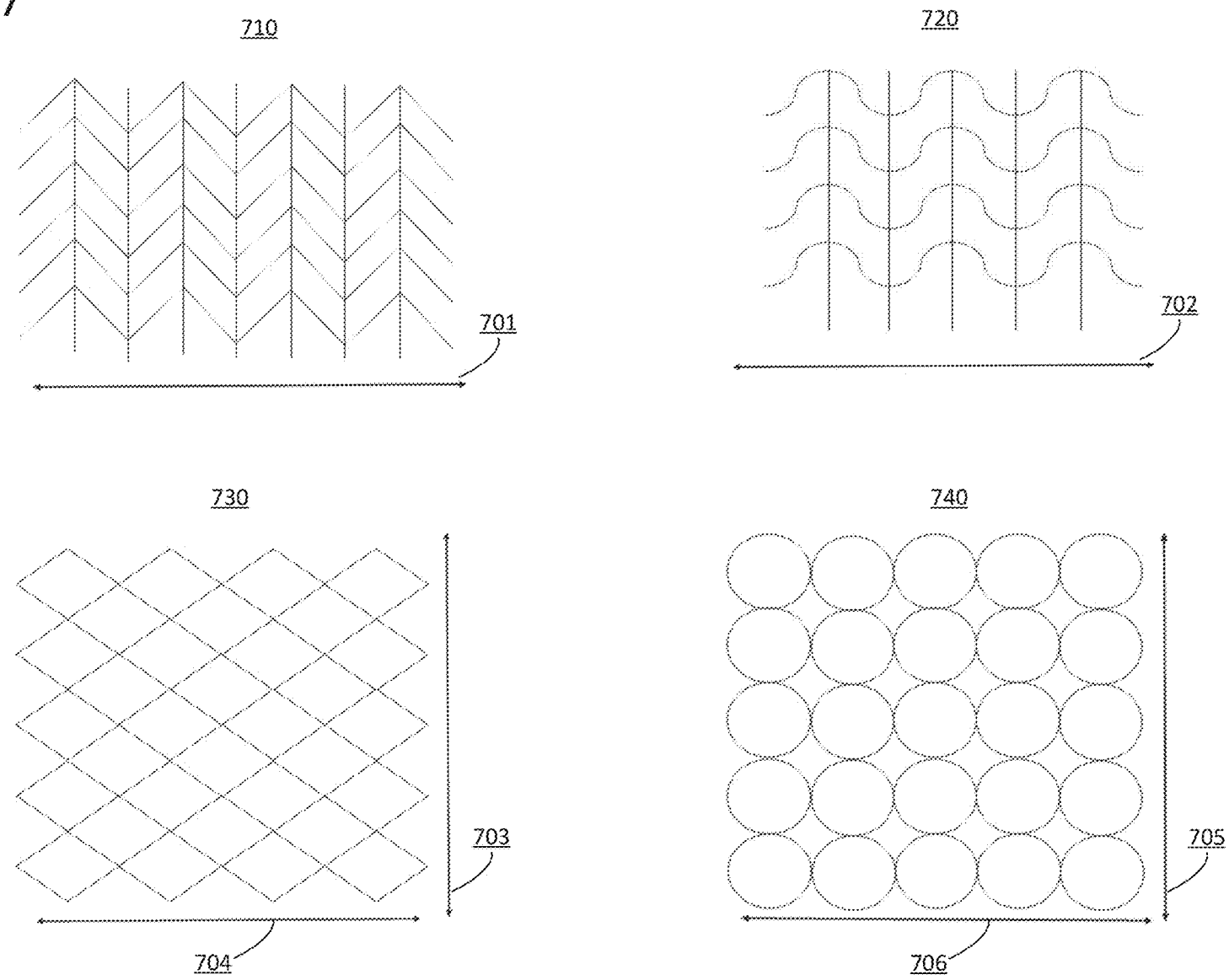
FIG. 7 illustrates various patterns that can be used for the support surface of the tuft assembly, in accordance with specific embodiments of the invention disclosed herein.

As described before in this disclosure, in some embodiments of the invention the whole tuft assembly can be flexible. However, in some situations, it is possible to favor the elastic deformability in more given directions (e.g., 1 or 2 given directions to provide a 2D springs surface). This can be achieved for example by using specific techniques such as the weaving or assembly pattern of the support surface (grid, mesh, or fabric). FIG. 7 illustrates various patterns that can be used for the support surface of the tuft assembly, in accordance with specific embodiments of the invention disclosed herein. Patterns 710 and 720 provide elongation along axes 701 and 702, respectfully. Patterns 730 and 740 however, provide elongation along two axes, 703 and 704, and 705 and 706, respectively, which could be used to provide a support surface with 2D springs.

Figure 8:
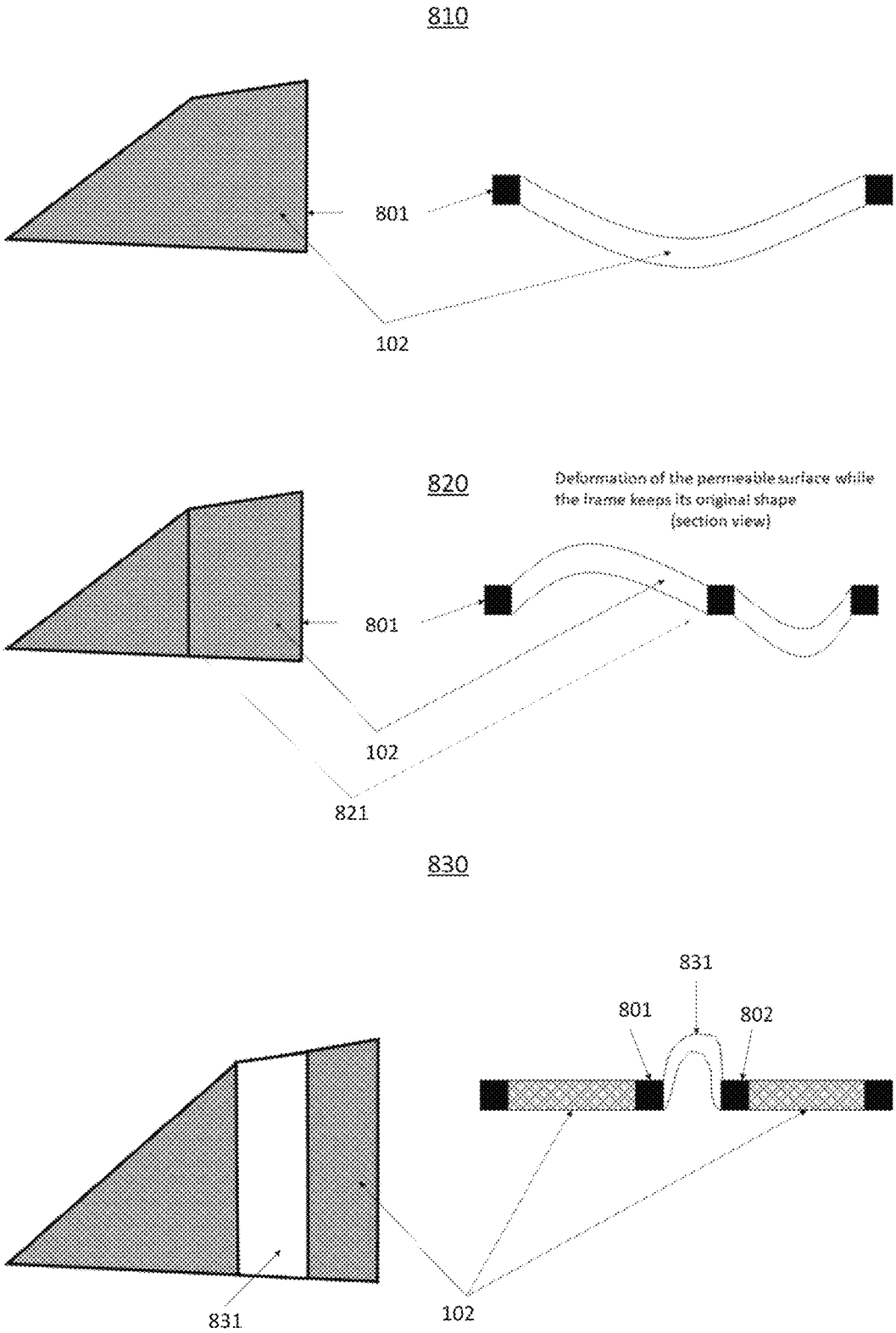
FIG. 8 illustrates various examples of support surfaces including a frame, in accordance with specific embodiments of the invention disclosed herein.

In specific embodiments of the invention, the tuft assembly can be partially flexible. For the partly flexible application, the rigidity can either come from localized areas of the support surface or from the bases of the tufts once attached to the support surface. In other embodiments, some areas of the support surface are rigid. For instance, if the support surface is a grid, a mesh or a fabric, the peripheral area can be made of a rigid material or present additional layers or loops to increase its rigidity. A frame can also be integrated to ensure that the tuft assembly keeps its shape while being able to present deformation in the middle of its structure. FIG. 8 illustrates various examples of support surfaces including a frame, such as frame 801, in accordance with specific embodiments of the invention disclosed herein. FIG. 8 includes section views of a support surface, such as surface 102. The sectional views illustrate a particular shape which is not a limitation of the present invention. Providing a frame, such as frame 801, could for instance favor the deformation of specific areas while maintaining the overall shape of the tuft assembly. Furthermore, the frame can be shaped to fit the supports and keep its shape while some areas would remain flexible. For example, as shown in image 820, frame 801 includes additional support 821 which allows the supports to keep its shape while other areas remain flexible.

Figure 9:
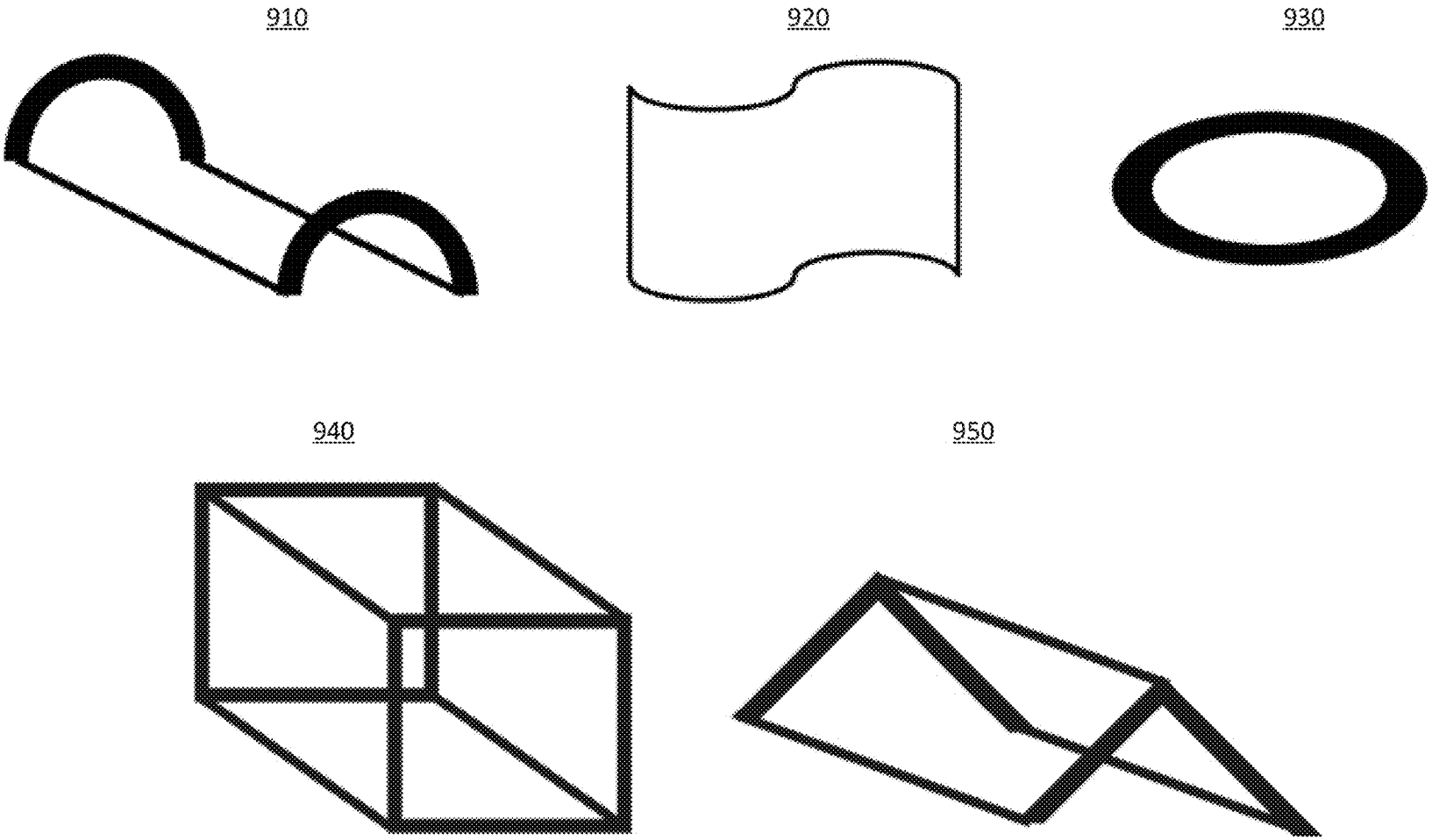
FIG. 9 illustrates non-limiting examples of various shapes that the frame could adopt, in accordance with specific embodiments of the invention disclosed herein.

In specific embodiments of the invention, the frame can separate two areas or zones of different elasticity or deformation potential (as shown in image 830, where a joint 831 can be provided in between frame 801 and frame 802). This configuration could be used to increase the overall elastic deformability or general elasticity of the assembly. It could also allow for a region of the tuft assembly to be moved while another region remains fixed thus articulating either rigid or flexible regions of the tuft assembly. Furthermore, it could be used to dump vibrations transmitted from one region to another. FIG. 9 illustrates non-limiting examples of various shapes that the frame could adopt, such as non-limiting shapes 910, 920, 930, 940, and 950.

Figure 10:
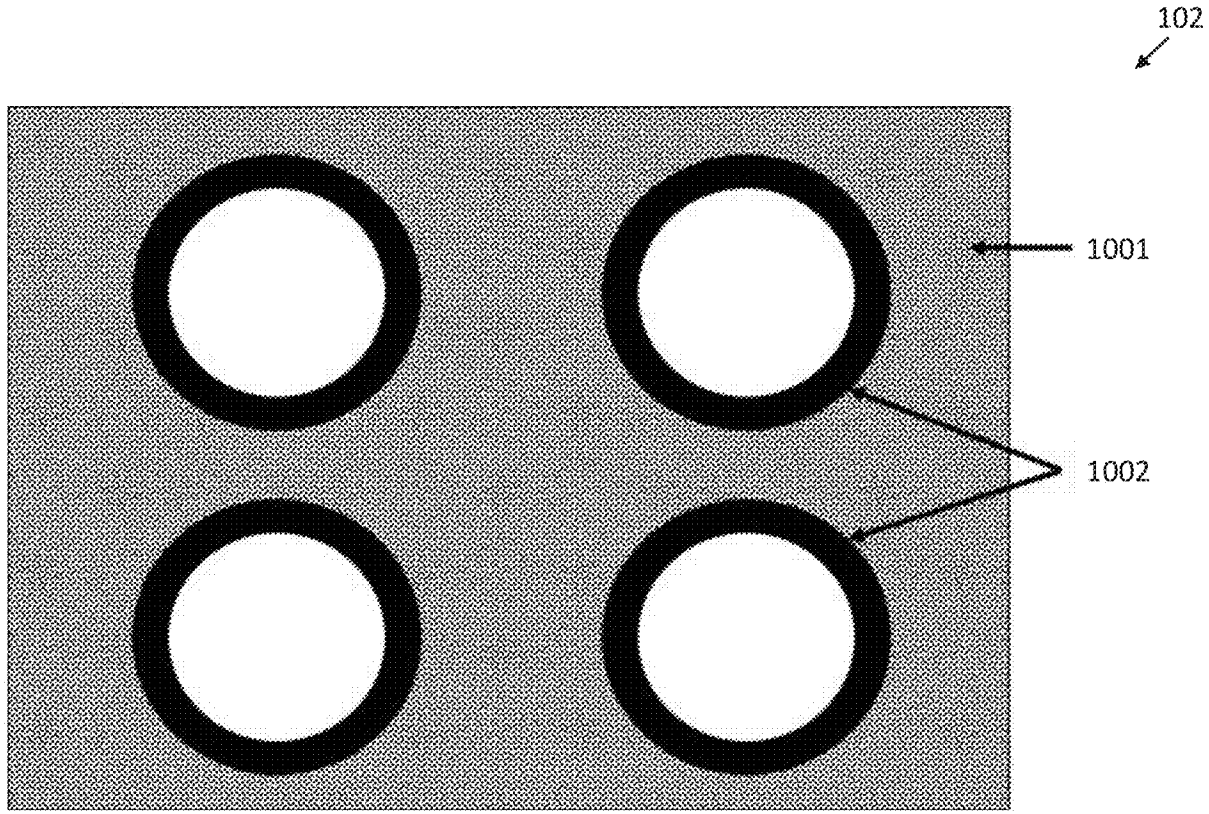
FIG. 10 illustrates an example of a support surface including rigid frames placed on a more elastic material, in accordance with specific embodiments of the invention disclosed herein.

In specific embodiments of the invention, the frame can surround the tufts. This configuration could allow for the extension or stretching of the tuft assembly without having the risk to damage the attachment of the tufts on the support surface. In this way, when a force is applied, this can cause a thinning of the surface and an augmentation of the surface area locally while the area directly surrounding the tufts keeps its original geometry. The deformation can be elastic or inelastic. FIG. 10 illustrates an example of a support surface 102 including rigid frames 1002 placed on a more elastic material 1001. Tufts can be placed inside the solid frames 1002 and remain intact when the support surface is deformed.

In specific embodiments of the invention, the tuft assembly can be a rigid tuft assembly. The fully rigid application could include a rigid support surface. If the support surface is a grid, a mesh or a fabric, this property can come from the dimensions of the threads and/or of the material and process used to fabricate the support surface. For instance, if metals, ceramics, or some polymers are used to create the support surface, such surface could be rigid. With such a process, the support surface could either be formed before or after the attachment of the tufts. In some embodiments, the tuft assembly can be first fabricated and then formed to fit a specific tool (e.g., toothbrush head, mouthpiece or any other appliance). The assembly can be bent, folded, heated, cut or any other forming process if the retention material remains intact.

Figure 11:
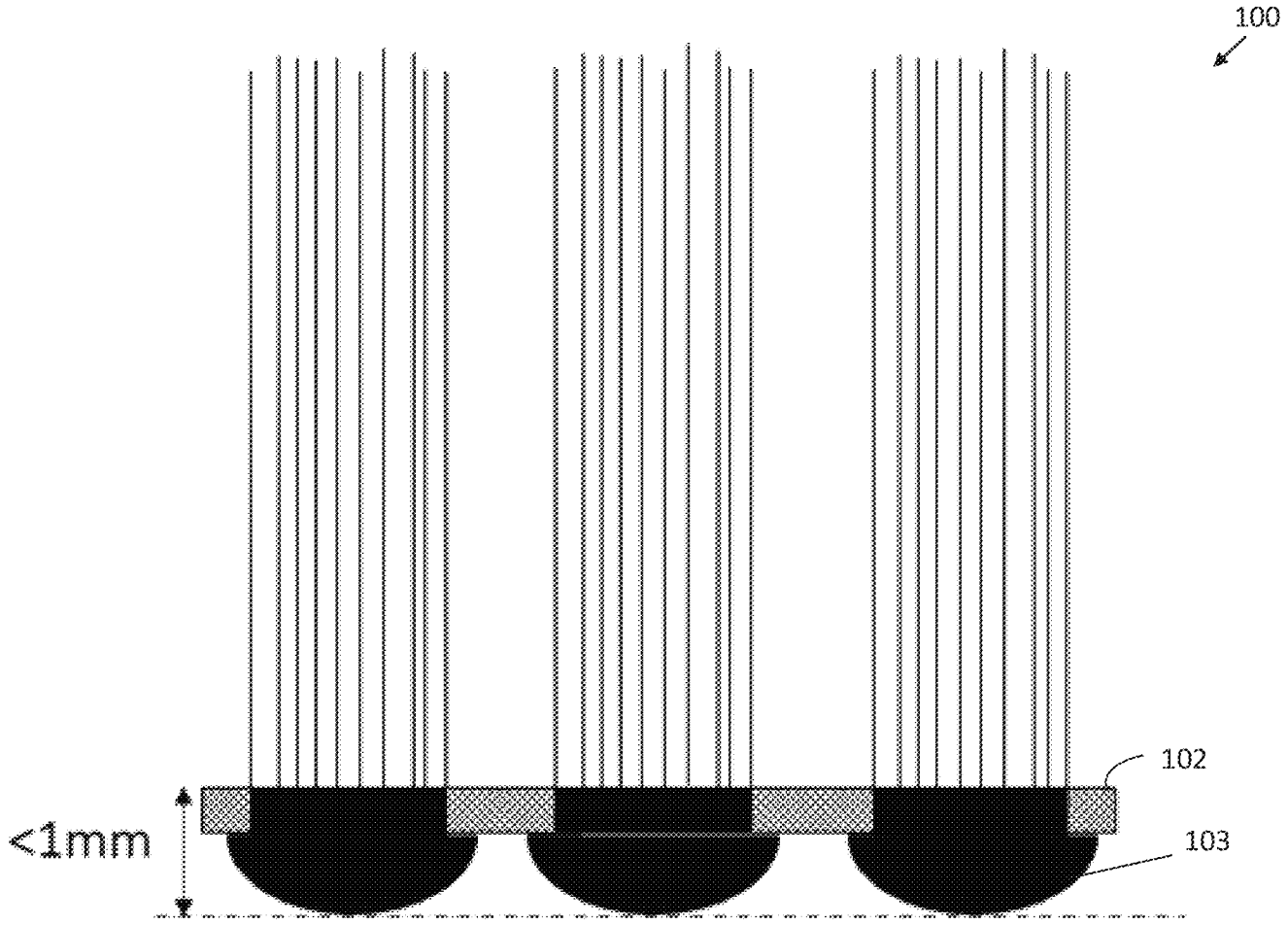
FIG. 11 illustrates a sectional view of a tuft assembly, in accordance with specific embodiments of the invention disclosed herein.

The tuft assembly solution can offer many advantages other than the efficiency of its fabrication process. For instance, the solution can offer a very compact way to strongly attach tufts (e.g., nylon tufts) to a support. In specific embodiments of the invention, to achieve this specification, the support surface (e.g., 102) can be thin. For example, a grid, a mesh, fabrics and drilled plates of any material can be used. The retention area (e.g., 103) can also be flattened to limit the thickness of the solution once the tufts are attached. FIG. 11 illustrates a sectional view of a tuft assembly, such as assembly 100. As illustrated, in specific embodiments of the invention it is possible to reach an overall retentive solution under 1 mm with a pullout strength exerted on a tuft exceeding 15 N. In specific embodiments, the thickness of the attachment can be between 0.3 mm and 10 mm while the pullout strength (the force to apply to a tuft to remove it from the support surface) can reach up to 60 N in these conditions.

Figure 12:
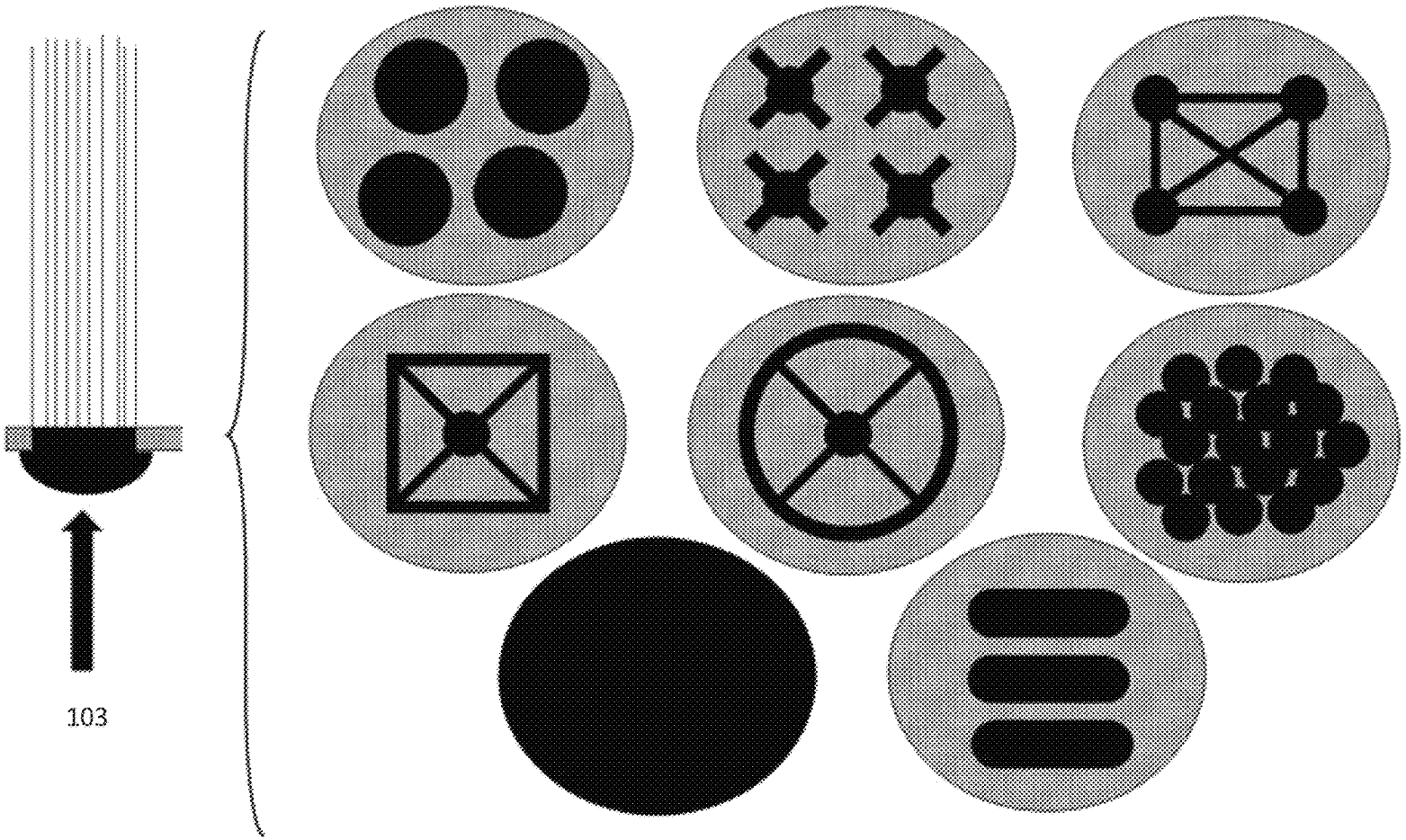
FIG. 12 illustrates various configurations for the retention shapes at the end of the tufts where the retention material can be located, in accordance with specific embodiments disclosed herein.

In some embodiments, the fused material protruding from the support surface (if any) can be shaped to either increase the resistance of the tuft to the pullout, limit the flexibility of the tuft assembly, confer good attachment properties to the support (tuft assembly carrier), create a seal, or provide other advantages. FIG. 12 illustrates various configurations for the retention shapes at the end 103 of the tufts where the retention material can be located.

Figure 13:
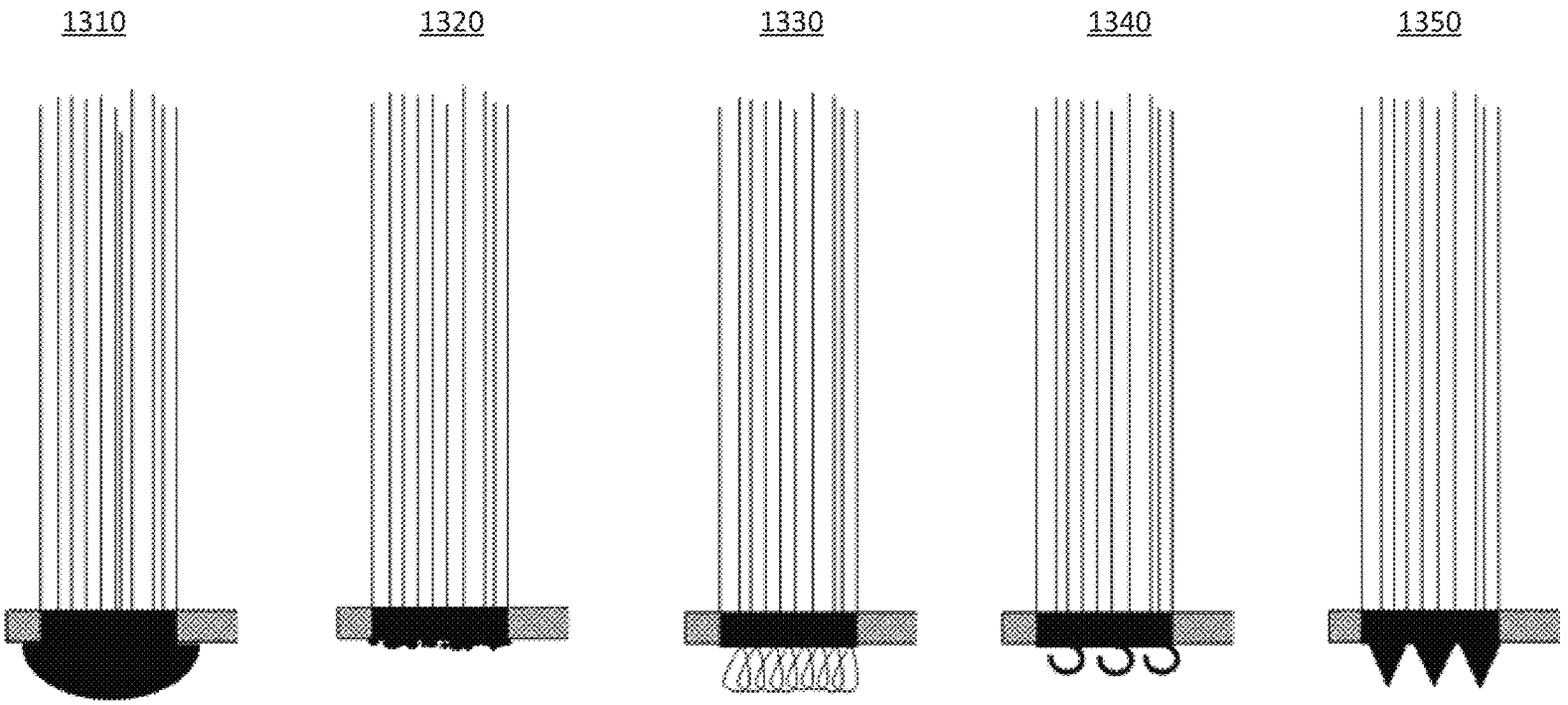
FIG. 13 illustrates examples of tuft assemblies in which the retention area is shaped and/or textured, in accordance with specific embodiments disclosed herein.

To create a more pullout resistant tuft assembly, the retention area can be shaped to have an extended base either in the form of a circle, a square pattern, a cross, a star, an oblong shape or any other suiting shape. To create a seal, the retention material can be extended over all of the permeable surface, thus filling the alveoli of the surface. The retention material can also be pressed against the surface to fill the surface on a deeper layer. To enhance the adhesion or attachment of the tuft assembly to its support surface (tuft assembly carrier), the retention protruding from the surface can be shaped or textured to ease its gluing, its clipping, its welding, its pressing in, its sewing, its screwing, or other properties. FIG. 13 illustrates examples of tuft assemblies in which the retention has been shaped and/or textured, in accordance with specific embodiments disclosed herein. Image 1310 illustrates a support complementary shape. Image 1320 illustrates a texturized base. Image 1330 illustrates a base comprising loops. Image 1340 illustrates a base comprising hooks or clips. Image 1350 illustrates a base with a saw-tooth profile. These and other configurations are possible. The solution can depend on many factors such as for example the complementary shape of the appliance or structure with which the assembly is going to be integrated.

Figure 14:
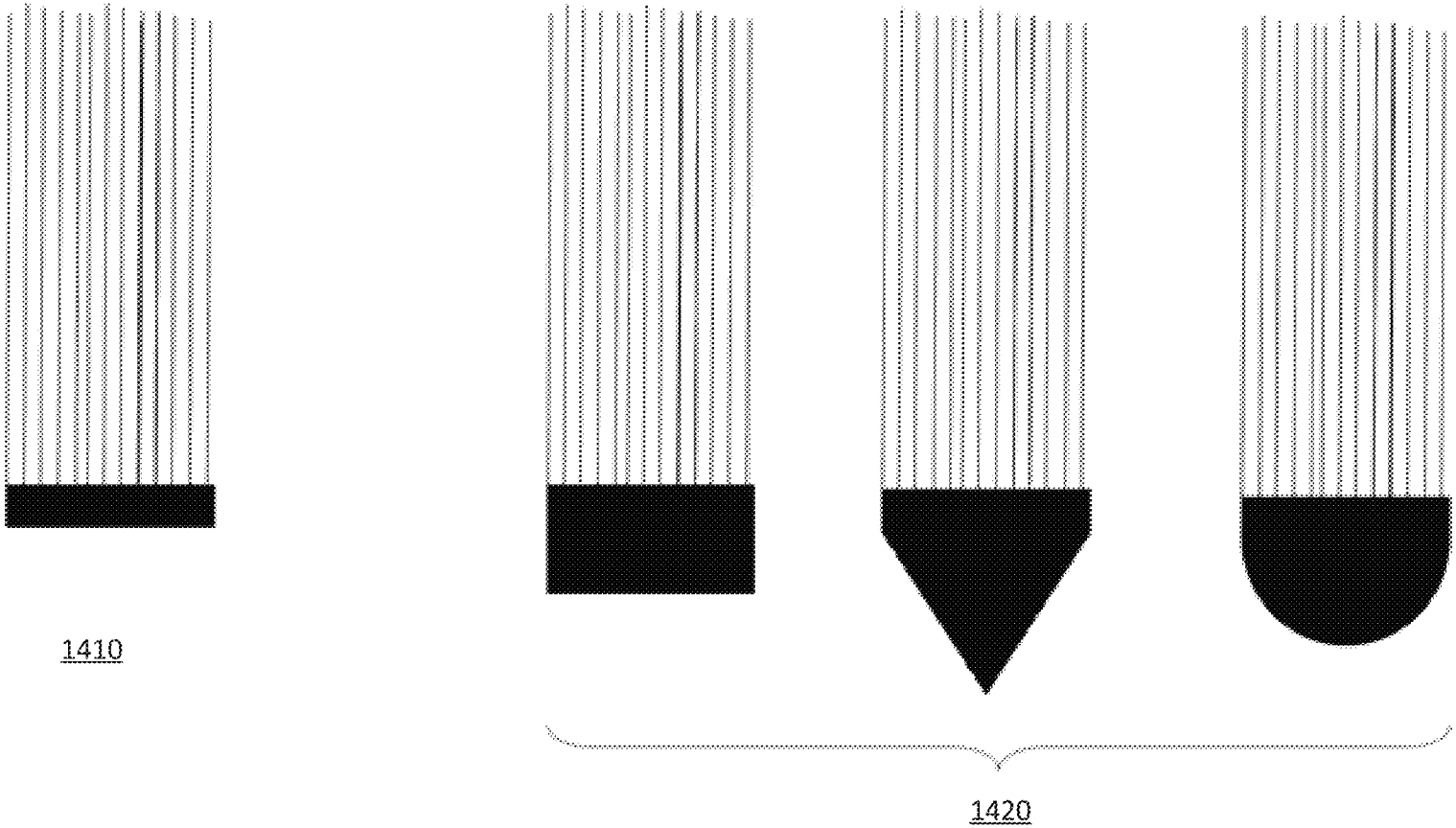
FIG. 14 illustrates examples of tufts with exceeding base material, in accordance with specific embodiments disclosed herein.

In specific embodiments of the invention, the filaments of the tufts that are used (to make the tuft assembly) can be attached to their base with exceeding material. This could ensure that enough material is fused during the heat process and that the tufts are strongly attached to the support surface. It could also ensure that the geometry of the base can be controlled. Another benefit to this technique could be to enhance the holding and resistance of the overall tuft. Indeed, the bristles filament could be fused together not only by their base but also by a portion of their length before the fusion reaches through the support surface making it harder to separate. Furthermore, the retention through the support surface can be thicker thus more difficult to break, enhancing the tuft pullout resistance. FIG. 14 illustrates examples of tufts with exceeding base material 1420, as opposed to a "standard" tuft 1410, in accordance with specific embodiments disclosed herein.

In specific embodiments of the invention, the support surface is a permeable surface. In specific embodiments of the invention, the permeable surface is a grid, a mesh or a fabric. The mechanical parameters of the grid/mesh that can be considered for the design of the tuft assembly can include but are not limited to the type of material used, elasticity of the material, diameter or dimensions of the apertures and threads (or edges for non-threaded or woven mesh), shape of the holes (round, oblong, square, star or any other shape), density of the holes, distribution of the holes (positioning), thickness of the grid, 2D or 3D shape of the grid, outer dimensions of the grid (peripheral dimensions), number of layers of grid or mesh (at least 1), border conditioning (reinforced thread, folding, etc.), etc.

Suitable materials for the support surface (e.g., grid/mesh) include but are not limited to metal, such as inox, nylon, silicone, TPE (high temperature resistant), TPU, carbon fibers, ceramic fibers, glass fiber, natural fibers, latex, rubber, high temperature resistant fabrics of any material, or other suitable materials.

The support surface can be made by using various techniques such as fabric fabrication techniques (threading, knitting, weaving, etc.), 3D printing techniques, extrusion, assembly of several layers of the grid (soldering, gluing, welding, etc.), die cutting, punch cutting, drilling, CNC techniques or other suiting techniques.

In specific embodiment of the invention, the material used for the support surface can have a melting point equal, slightly or much higher than the melting point of the material of the brushing elements (i.e., tufts). More specifically and for better results, the temperature that is applied to melt the base of the tuft (e.g., the retention material) could be one that does not create permanent deformation in the support surface. For example, if the tufts are made of nylon with a melting point of 270° C., an inox grid with a melting point of 1500° C. could be used as the permeable surface of the tuft assembly. In another use case, TPE tufts with a melting point of 220° C. could be attached to a polyester mesh with a melting point of 255° C.

Different properties can be considered when selecting the material of the support surface. For example, in a metal grid embodiment, the resistance to tearing in the case of a metal grid can be greater than 15 N and can even exceed 60 N. The grid can then be covered with silicone or glued directly into the gutter using silicone. However, the resulting appearance can be uneven and show soiling that may not be compatible with a medical application. In specific embodiments of the invention, an optimum temperature for a base fusion of nylon tufts can be approximately 230° C. At this temperature, the nylon could melt without charring nor leaving black marks on the support while an inox grid could remain intact. In the more specific inox metal grid embodiment, inox can be assessed as the best compromise. In a glass fiber grid embodiment, a fabric from which glass fibers are 30 μm in diameter can be used. The flexibility of such material can be comparable to that of silk and provides good fusion with nylon tufts.

In specific embodiments of the invention, the material of the support surface can be chosen among biocompatible options to allow the implementation of the pad into medical devices or its contact with skin, mucosa, or other sensitive surfaces.

Figure 15:
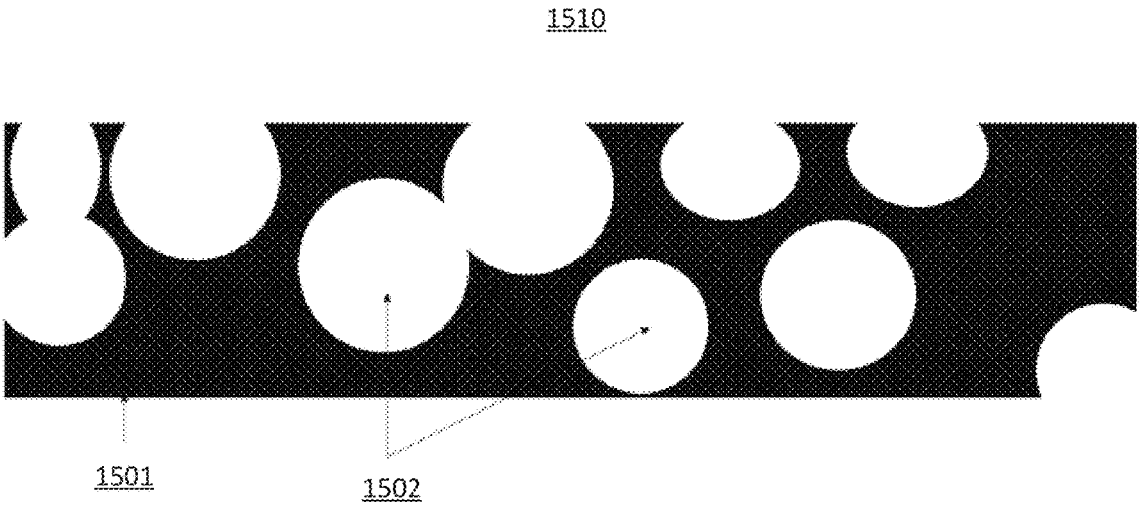
FIG. 15 illustrates examples of a support surface which includes a porous material with cavities, in accordance with specific embodiments disclosed herein.
Figure 15:
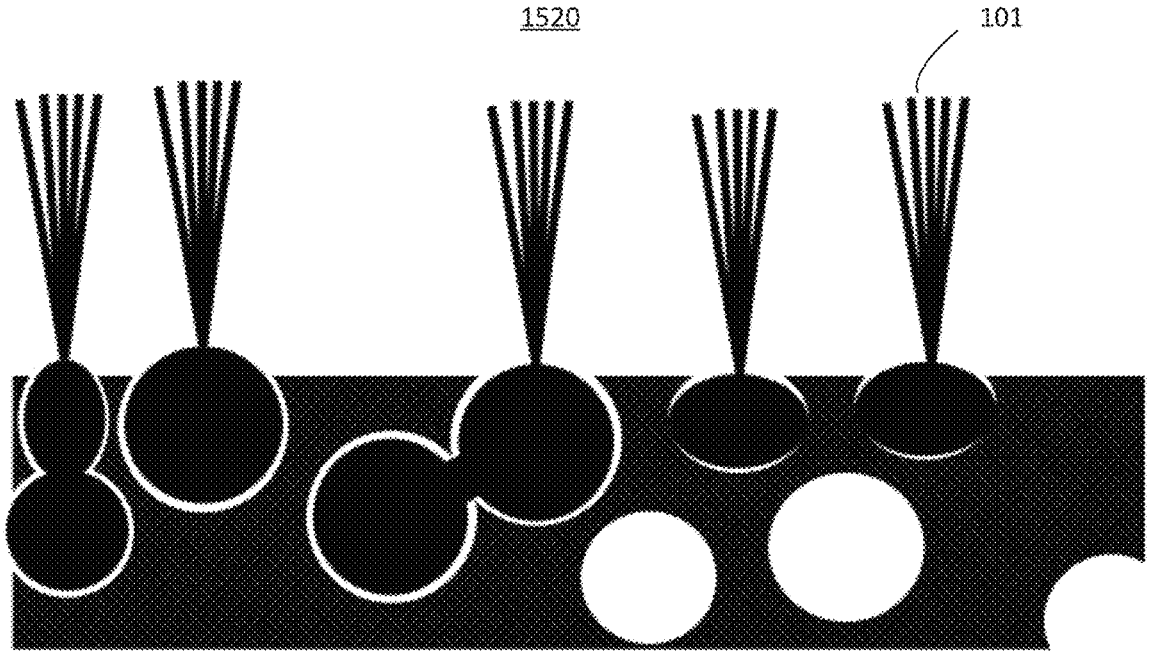

In specific embodiments of the invention, the support surface is (fully or partly) thermoformable and chemically compatible with the tuft material meaning that the support surface can partially or fully fuse with the base of the tufts during the assembly process. This fusion between the support surface and the tuft material can increase the tuft pullout resistance. It could also clog holes in the support surface thus limiting the risk of bacterial contamination or dirt and debris from remaining in the support surface. In specific embodiments, the support surface can be replaced by a porous material that can act in a similar way. The molten retention material of the filament base can flow through the porosity and create retention inside or through the porous plate. Furthermore, by pressing and releasing the porous material, it is possible to create a suction that can help the molten material of the tuft penetrate the porous support. In some embodiments, the porous material is one of a fabric, a sponge, a foam, or the like. The tuft/retention material, once fused, can create retention in the cavities of the porous material. FIG. 15 illustrates examples of a support surface 1510 which includes a porous material 1501 with cavities 1502, in accordance with specific embodiments disclosed herein. View 1520 illustrates the tufts 101 being fused inside the cavities, for example when the porous material is heated.

In specific embodiments of the invention, the support surface and/or the tufts attached thereto might be sealed and/or encapsulated inside a specific layer of material such as silicone, latex, resins or other material. The encapsulation can provide advantages such as limiting bacterial growth on the assembly, apply mechanical constraints on the assembly to shape it, protect the assembly from deforming permanently, create a surface suitable for attachment to the support (gluing, welding, clipping, etc.), increase assembly lifespan, and others.

The encapsulation can be localized meaning that the encapsulation may not be for the full assembly, and the material (e.g., a thermoformable material) can only cover a portion of the support surface. For instance, the material could be added in areas where the tuft needs a stronger retention. For instance, the edge of the tuft assembly could be covered by a line of fusible material to ensure strong attachment of the tufts on its periphery. In a similar way, it could also be possible to protect areas from fusing material. This could prevent specific areas of the support surface from being covered with the brushing elements material. For instance, to have sharp assembly edges and ensure the assembly will respect given dimensions, the edges could be protected (e.g., by the sealing/encapsulating material) from the melted material of the tufts flowing and then cooling, reaching areas out of the edge of the support surface. In another example, some areas of the assembly might be subject to additional stress or movement during its use or assembly. The tufts located on these specific areas might be provided with stronger attachment or a more elastic coupling. An added material (e.g., sealing and/or encapsulating material) dropped on the assembly may achieve such requirements. The sealing material can be added by immersing the area of interest (e.g., support surface or at least part of it) in the sealing material, or by applying the sealing material locally by other means, such as by spraying the material on the area of interest. The sealing material can undergo one or more processes such as application of heat and/or change of state so that the seal is created. For example, a solid layer of sealing material can be placed on the support surface. The sealing material can then be heated so that it is transitioned to a molten state and the seal can be created. Its temperature of fusion can be lower than the temperature of fusion of the rest of the assembly (e.g., the retention material) so that the creation of the seal does not interfere with the rest of the assembly.

In specific embodiments of the invention, the support surface is a grid where the holes are filled with fusible material to enhance the attachment of the tufts to the grid. In specific embodiments, the grid or mesh can be partially covered with a coating that ensures a temporary heat protection. This could allow the use of material with their fusing point equal or even below the melting point of the brushing elements. The coating could either be destroyed during the pad fabrication process or be removed afterward (by cleaning, dissolution, mechanical removal, etc.).

Sealing material for encapsulating the permeable surface could include but is not limited to TPE, Silicon, Latex, Resin, Varnish, Wax, Paint, a coating with active agents (flavor release, antibacterial, coloring agents, etc.).

In specific embodiments of the invention, sealing might be made of biocompatible material for medical applications, such as: silicone, doped silicon (with Ag, Cu), TPE, TPU, Latex, Nitrile, Polyamide, Polymers, Ceramics, Metals, Composite materials, etc. In specific embodiments, the encapsulating material can be used in dental care applications such as, but not limited to manual and powered toothbrush, whitening devices, tongue scrapers, interdental areas brushing devices, vibrating devices based on mouthpiece shaped brushing head, pneumatic devices based on the deformation of a flexible part to actuate the brushing head or any other brushing head dedicated to the cleaning, healing, whitening, massaging of the oral environment or any other oral care action. For these applications, the different materials of the tuft assembly can be either biocompatible or encapsulated in biocompatible materials.

Figure 16:
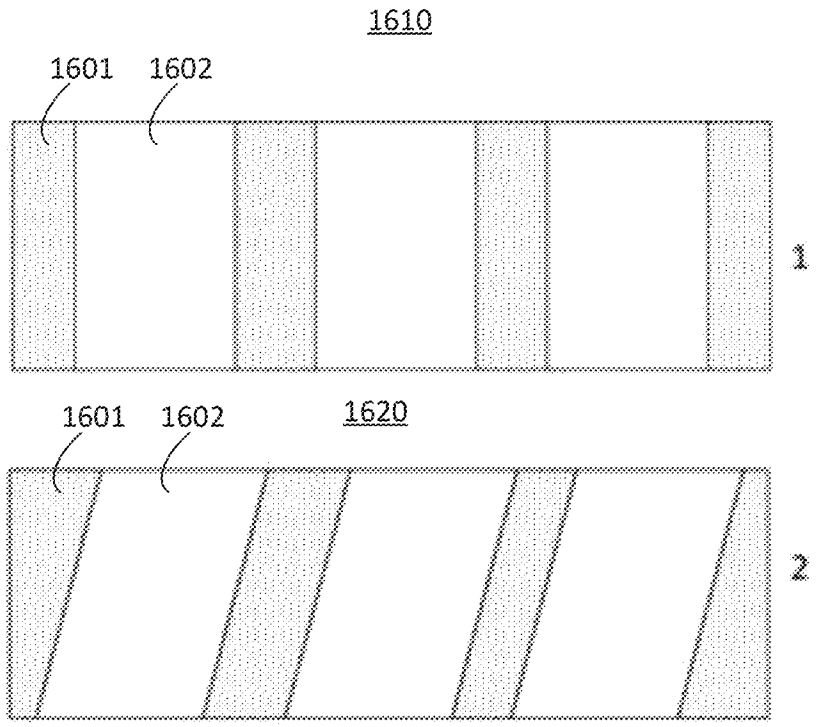
FIG. 16 illustrates an example of a support structure comprising apertures, in accordance with specific embodiments of the invention disclosed herein.
Figure 16:
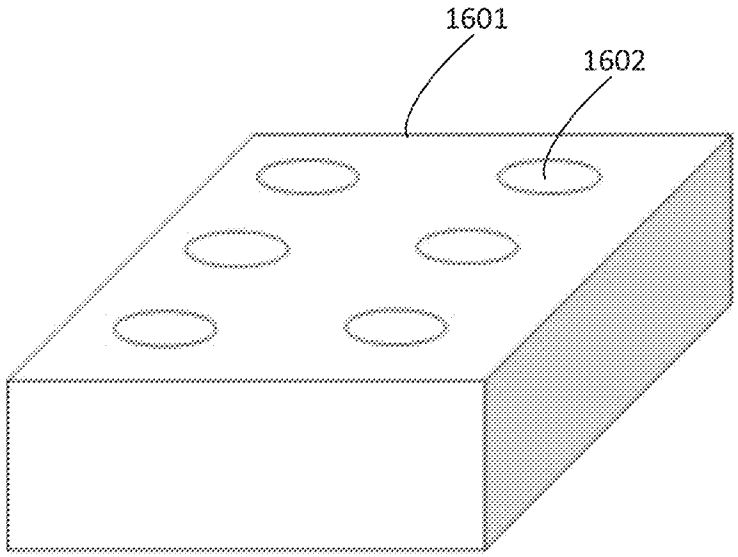
Figure 17:
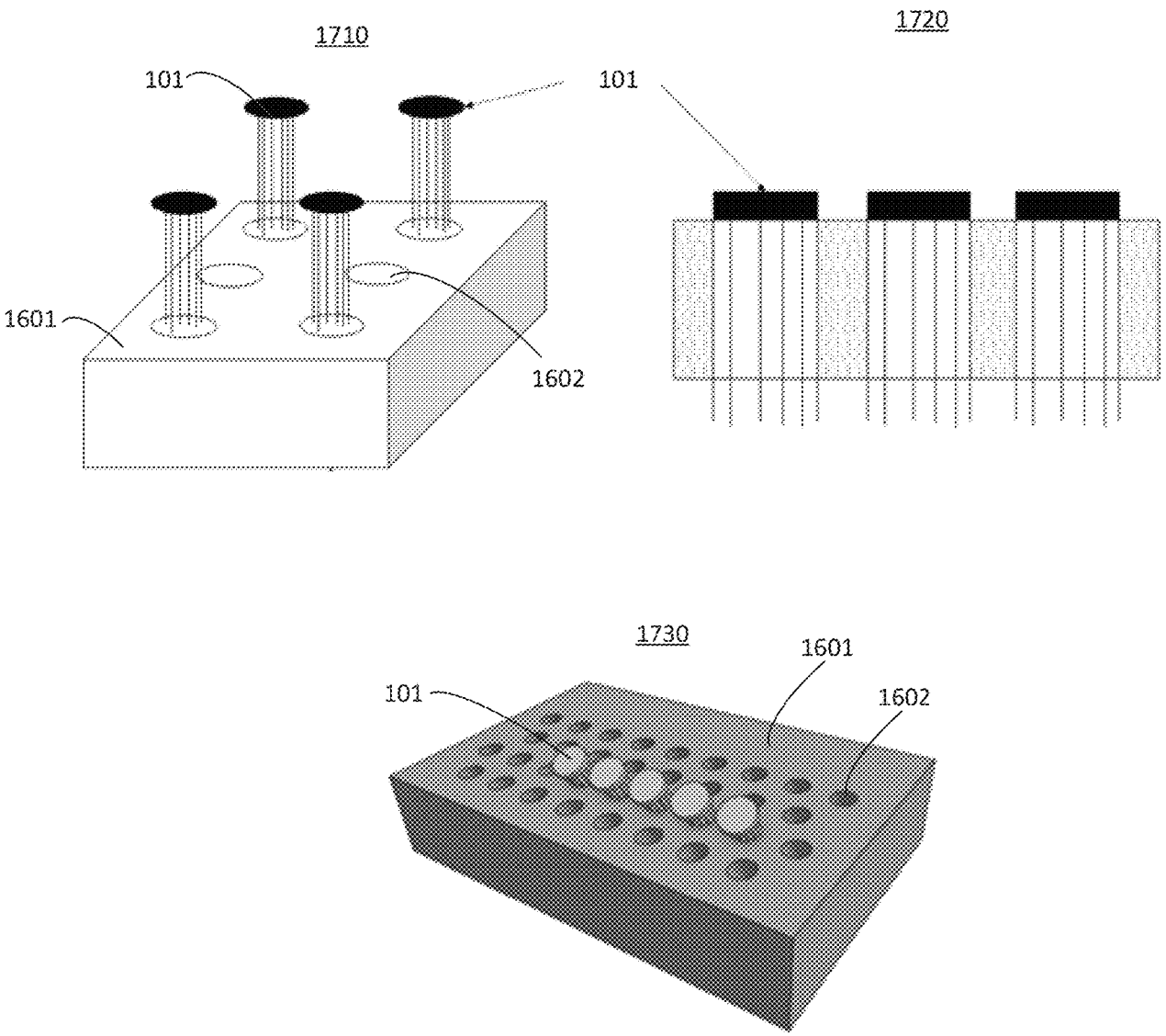
FIG. 17 illustrates the tufts placed in a support structure, in accordance with specific embodiments of the invention disclosed herein.

A tufts assembly in accordance with specific embodiments of the invention can be manufactured following various manufacturing processes. Exemplary manufacturing processes will be described below. In specific embodiments of the invention, a support structure can be used. The support structure can include apertures for the tufts. FIG. 16 illustrates an example of a support structure 1601 comprising apertures 1602. As illustrated, the apertures can be perpendicular, as in sectional view 1610, angulated, as in sectional view 1620, or a combination thereof. The tufts can be placed inside the support structure so that the support structure holds them in place. FIG. 17, and more specifically view 1710, illustrates the tufts (e.g., 101) being placed in a support structure (e.g., in the openings 1602 of support structure 1601), in accordance with specific embodiments of the invention disclosed herein. Sectional view 1720 illustrates the tufts already inserted in the openings of the support structure. View 1730 illustrates a perspective view of an embodiment in which the tufts were inserted in angulated openings of the support structure.

Figure 18:
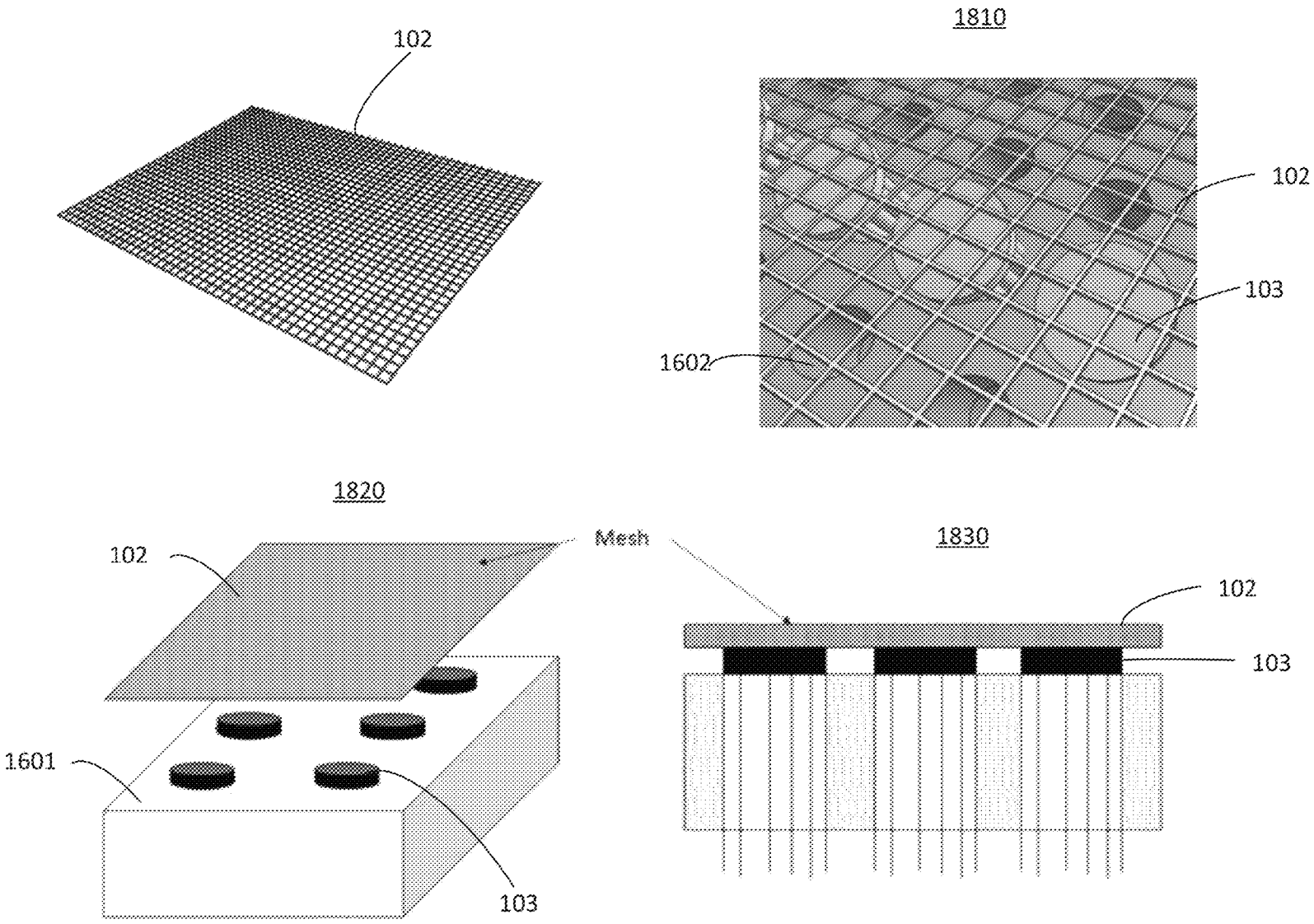
FIG. 18 illustrates an exemplary support surface and the process of placing it on the base of the tufts, in accordance with specific embodiments of the invention disclosed herein.

In specific embodiments of the invention, the support surface (e.g., a grid or a mesh) can be placed on one end of the tufts. If a support structure is used as described with reference to FIG. 16 and FIG. 17, the support surface can be placed on a first surface of the support structure. The exposed end of the tufts (the base of the tufts) can slightly protrude from the support structure as illustrated in FIG. 17. FIG. 18 illustrates a support surface 102 and the process of placing it on the base of the tufts, in accordance with specific embodiments disclosed herein. The support surface in this example is in the form of a mesh/grid. As illustrated in view 1820 the support surface 102 can be placed on top of a support structure such as support structure 1601. The base of the tufts (e.g., 103) can then be in contact with the support surface (102) when the support surface is placed, as illustrated in sectional view 1830. View 1810 illustrates a perspective view of this process.

As described before in this disclosure, a retention material can be provided on one end of the tufts to hold the tufts and the support surface together. The retention material can be provided on the base 103 of the tufts. The retention material can be the material of the tufts itself or another material added to the base. In this way, when the support surface is placed therein, a process can be undertaken so that the two structures are connected together via the retention material. In specific embodiments of the invention, the support surface can be permeable to the retention material so that the retention material can "penetrate" the support surface. In the example of a grid or mesh, the retention material can penetrate the grid or mesh via the apertures of the grid or mesh.

Figure 19:
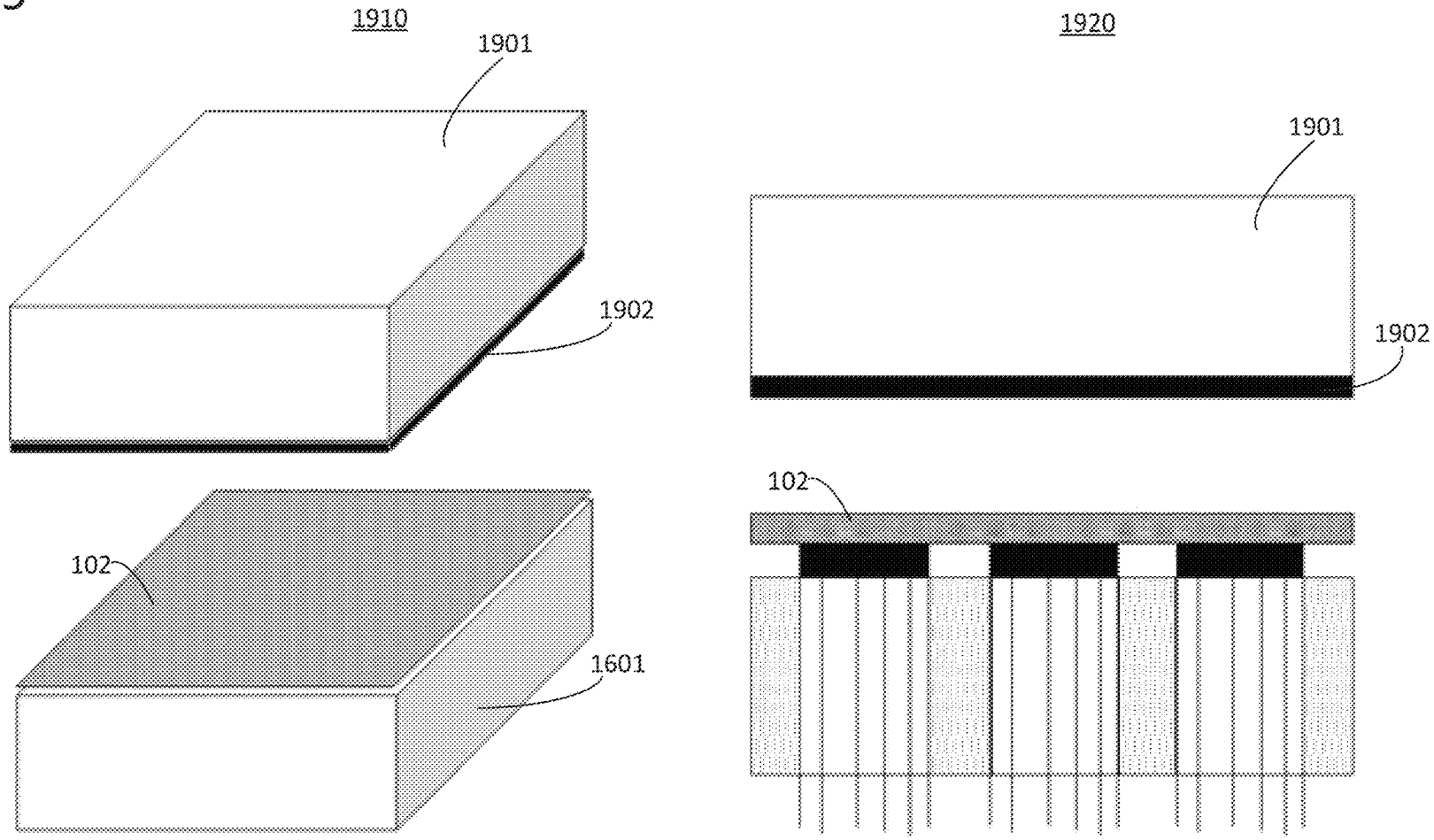
FIG. 19 illustrates an example of a heating plate applied on the first surface of the supporting structure, in accordance with specific embodiments of the invention disclosed herein.

The support surface can be permeable to the retention material when the retention material is in a molten state. In this way, if the retention material is not in a molten state, the manufacturing process can include the process of transitioning such material to a molten state so that it can permeate the support surface. This can be achieved in various ways. For example, heat can be applied to the retention material to transition it to a molten state. FIG. 19 illustrates an example of a heating plate 1901 applied on the first surface of the supporting structure, in accordance with specific embodiments of the invention disclosed herein. Both perspective view 1910 and sectional view 1920 illustrate the heating plate 1901 comprising a contact surface 1902, which will ultimately apply heat to the retention material and transition it to a molten state.

Figure 20:
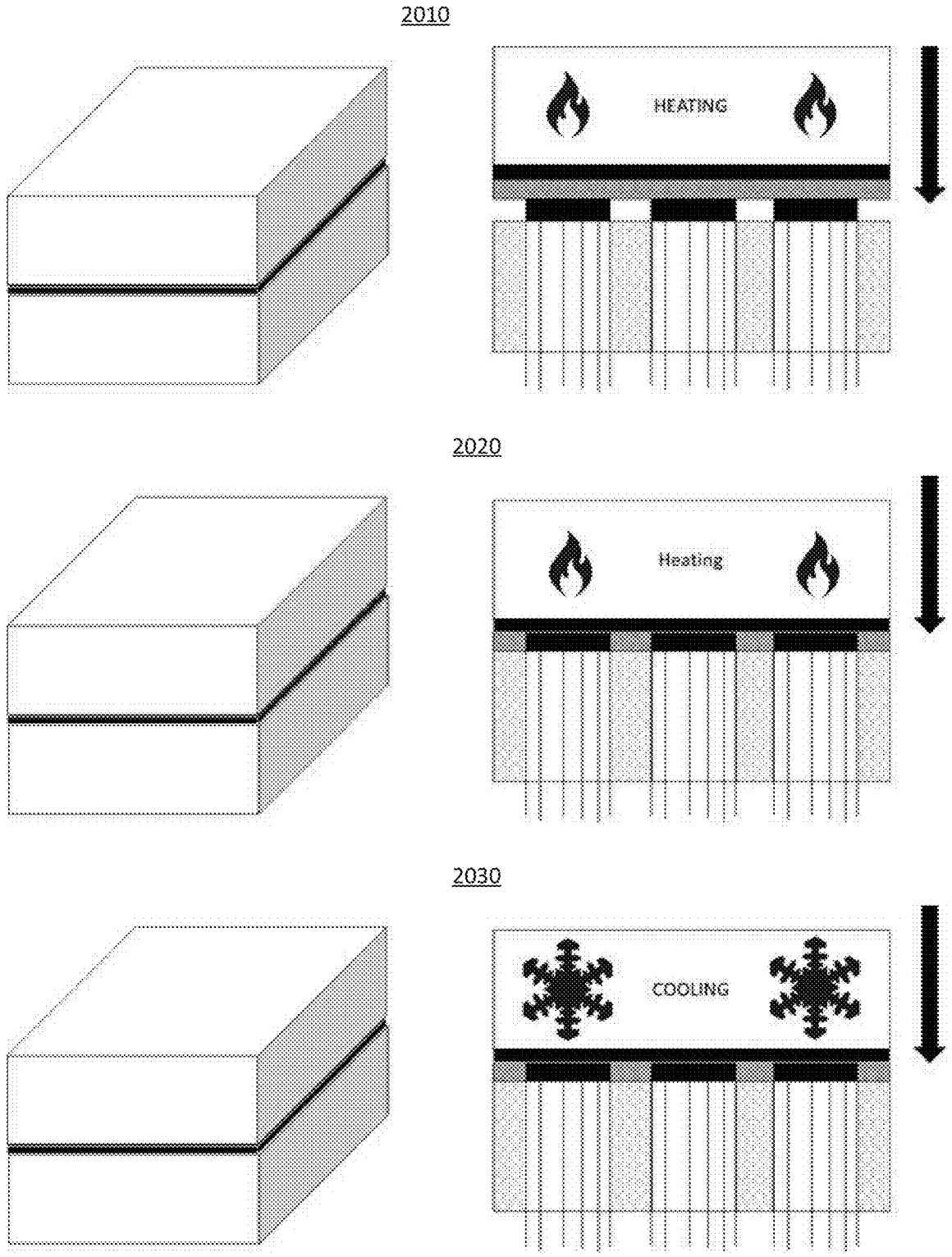
FIG. 20 illustrates the process of applying heat via a heated press or plate, in accordance with specific embodiments of the invention disclosed herein.

FIG. 20 illustrates the process of applying heat via a heated press or plate (e.g., 1901) in more detail. The heated press or plate can be pressed against the support surface (and/or support structure holding the assembly). The heating plate can reach a certain temperature and remain applied with a calibrated pressure on the supporting structure for a monitored amount of time. This process is illustrated in view 2010. In that time, the base of the tuft (either a separate retention material or a tuft formed from the retention material directly) can be transitioned to a molten state because of the applied heat. When the support surface is permeable to the retention material in a molten state, the material can permeate the surface. For example, if the support surface is a grid, the material can "penetrate" the grid. In other words, the retention material can flow through the grid. This process is illustrated in view 2020. The pressure applied by the press can push the support surface down and into the retention material to facilitate this process. The support surface (e.g., grid) can have a temperature of fusion that is higher than a temperature of fusion of the retention material. In this way, the grid can present none to very limited deformation during the process of transitioning the retention material to a molten state.

Figure 21:
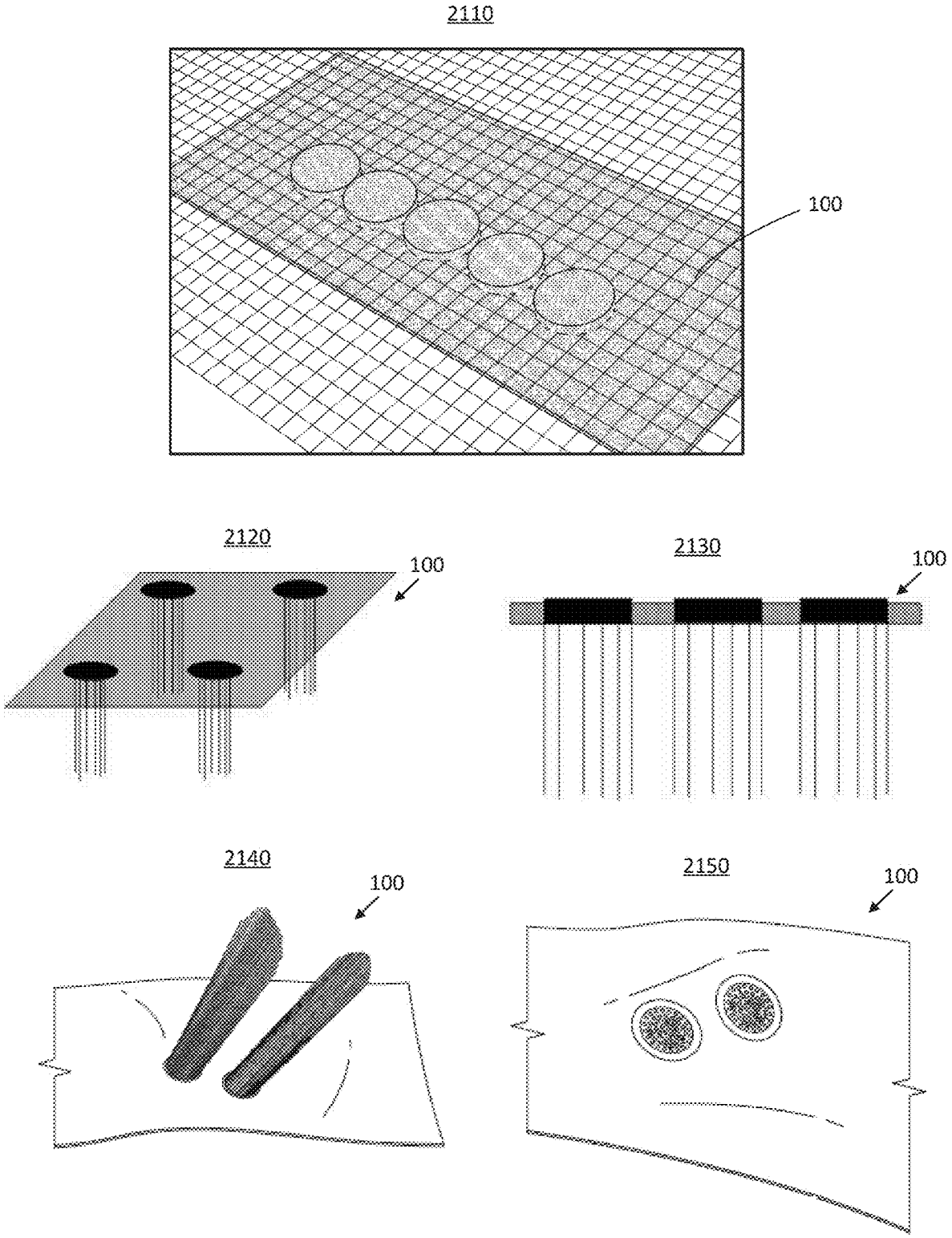
FIG. 21 illustrates an example of the tuft assembly pad removed from the support surface, in accordance with specific embodiments of the invention disclosed herein.

After this process, the heating plate might either be removed or cooled down (as illustrated in view 2030) to ensure that the material of the tuft comes back to a solid form. The retention material can now be said to be fused into the support surface, and the tufts connected to the support surface via the retention material. The tufts can be gripped into the grid and strongly attached to it to form a pad (tufts assembly). The pad formed by the permeable support surface (grid) and the tufts can be removed from the support structure. FIG. 21 illustrates an example of the tuft assembly pad being formed in view 2110. Views 2120 and 2130 illustrate the assembly once it is removed from the support structure. View 2140 illustrates a prototype including two tufts obtained with the processes described above. View 2150 is a back view of the prototype of view 2140 and illustrates the base of the tufts and/or retention area for the tufts.

A heating plate, such as heating plate 1901, can have various properties. For example, the heating plate can provide certain functions including but not limited to heating the retention material, applying pressure to the material, forming the base of the tuft (specific shape), cooling the brushing element material, and other functions. Every one of these functions can be performed by the heating plate alone or by a set of specific tools. For instance, the heat can be conducted to the base of the tuft through the grid with electrical means (e.g., high voltage circulation through the mesh), heat guns, friction, localized microwaves, welding techniques, laser, or IR (optic) techniques, rapid compression cycles (heat can be caused by the material volume change), light, vibrations, etc.

In specific embodiments of the invention, the heating plate can present a specific interface (e.g., surface 1902 can be a specific type of surface) to contact the tuft material/retention material. This surface can be selected to limit the potential adhesion of the tuft material to the tool, to ensure homogeneous temperature distribution or local control of the heating/cooling, to ensure homogeneous pressure distribution or local control of the pressure (on the peripheral for instance), to ensure durability of the tooling, and other associated concerns. In specific embodiments of the invention, the thermal inertia of the surface can be weak to achieve rapid temperature variations. This interface can be permanent (e.g., permanently attached to or be the plate 1901 itself) or replaceable. It can be made of steel, ceramics, aluminum, composite materials or other suitable material. This surface can also be textured or shaped to confer a specific texture or shape to the base of the tufts.

In specific embodiments of the invention, the heating surface can also have edges to cut the pads in smaller pieces when pressure is applied. This could allow the creation of parts to the right size and shape, suitable for assembly on a brushing head for instance.

In some embodiments, the grid or mesh can be detachably attached to the heating plate using removable or deactivatable glue, clips, clamping assembly, magnetic system or other means. In specific embodiments of the invention, the contacting surface can be composed of flexible material to ensure homogenous heat and pressure distribution on the pad. The layer of flexible material can either be thick or thin. In specific embodiments of the invention, the quality of the fusion operation can be greatly improved by the interposition of an aluminum layer (e.g., aluminum sheet or foil) between the hotplate and the grid. The aluminum layer can allow isolation of the hotplate, preventing it from being soiled by molten nylon. It can also allow the passage of the molten nylon on the other side of the screen, improving the retention of the tuft. It can also allow a very clean finish because the aluminum foil, once cooled, can be removed easily without adhering so that the part of nylon that has fused to the other side of the grid is perfectly smooth.

The support structure, such as support structure 1601, can have various properties. As illustrated before, this support structure can help place, orient, and maintain the tufts during the fabrication process, and it is removed at the end of the process. The support structure can either be rigid or flexible. If the orientation of the tufts is locally close to perpendicular to the heating surface, then the support structure can be rigid and made in one part. It can be made of ceramic, metal, natural materials (such as wood), heat resistant plastics, or other suitable material. If the tufts are forming a narrow angle in reference to the heating surface, if the geometry of the heating surface is not flat or if the orientation of some tufts varies, the support structure can either be an assembly of rigid parts, flexible or dissoluble. It can be made of silicone, latex, nitrile, wax or other suitable materials. In specific embodiments of the invention, the support structure can also limit or prevent the heat transfer from the heating plate to the filament's length, limiting the fusion of the tuft to its base. This limitation can ensure that the filaments keep their shape during the heating process even if the retention material is the filament's material itself. In some applications, the need for a flexible support structure does not occur as the pad assembly is flexible and thus can be removed from the support structure regardless of its rigidity.

Figure 22:
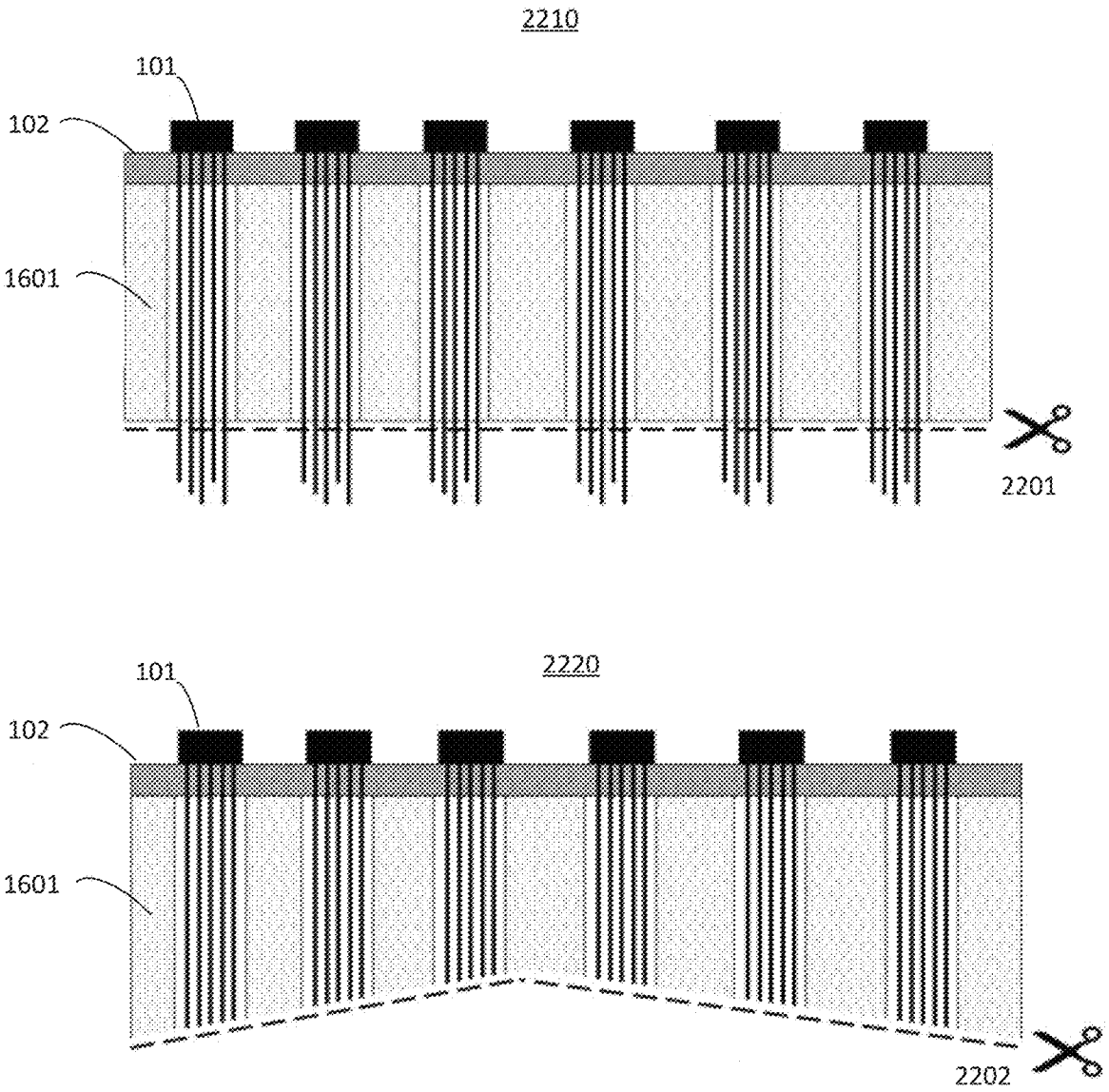
FIG. 22 illustrates examples of a support surface used to guide the trimming of the filaments, in accordance with specific embodiments of the invention disclosed herein.

In specific embodiments of the invention, the support structure can be punctured with orifices that form a channel from one side of the structure to the other, as illustrated in views 1610 and 1620 in FIG. 16. In this way, the free extremities of the filaments can protrude from the support structure. This structure can then be used to guide the trimming system and ensure the filaments are cut at the right length. This length can be different from a tuft to another or even within a same tuft, as previously described in this disclosure. FIG. 22 illustrates examples of a support surface such as support structure 1601 used to guide the trimming of the filaments. View 2210 illustrates a trimming line 2201 with which each filament can have the same length, and view 2220 illustrates an alternative trimming line 2202 with which different filaments can have different lengths. As illustrated, the trimming line can be defined by a shape of the support structure 1601.

Figure 23:
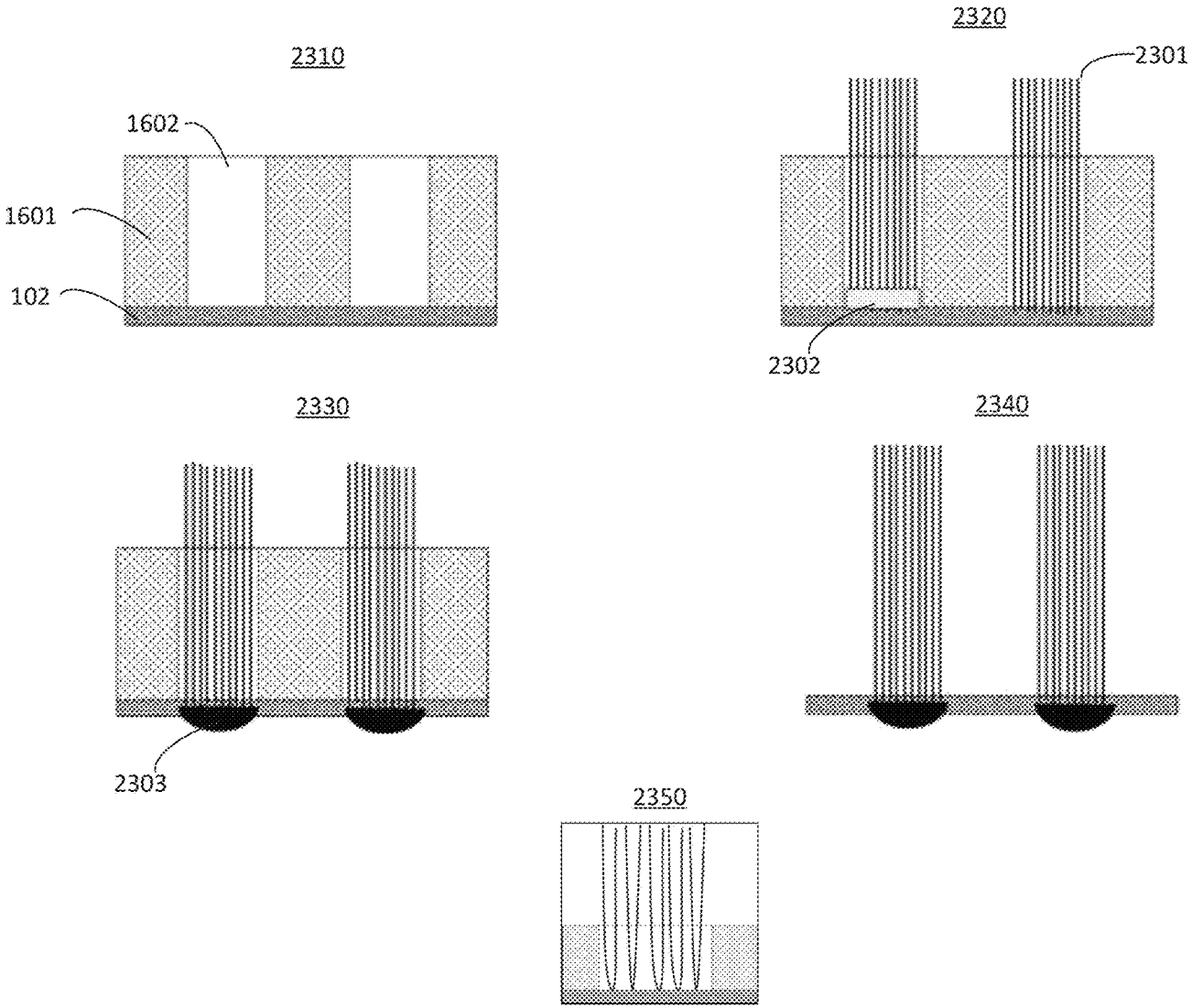
FIG. 23 illustrates an example of the process of fusing the tufts together during the manufacturing process, in accordance with specific embodiments of the invention disclosed herein.

In specific embodiments of the invention, the tufts themselves can be created while its material is fused through the support surface. For example, individual filaments can be placed inside a hole in a support structure (e.g., apertures 1602 and support structure 1601 in FIG. 16). FIG. 23 illustrates an example of the process of fusing the tufts together during the manufacturing process, described though views 2310, 2320, 2330 and 2340. The filaments (e.g., 2301) can be inserted in numerous ways. If they need to be adjusted, the support structure can be vibrated to ensure a good position of the filaments. In specific embodiments of the invention, the grid used for the fusion can present smaller apertures than the filaments diameter. In other situations, a small pastille (e.g., 2302) made of thermoformable material can be inserted between the grid and the filaments to ensure that no filaments can protrude or fall from the grid, depending on the orientation of the support structure. When the filaments are in place, the heating process can melt the independent filaments to both form a tuft and to create the retention around the grid, around area 2303. If used, the pastille could either fuse in the retention or dissolve during the operation (no remaining traces). The retention can be created by the material of the filaments themselves or by providing a retention material on the filaments. The pad can then be safely removed from the support structure as illustrated in view 2340.

With the process described above of forming the tuft from individual filaments, the tuft could be made of various different filaments. For example, different thermoformable materials, different filaments diameter, different filaments length, different filaments shape (straight, conical, wavy, square, etc.) Furthermore, this technique could help creating tufts of various shapes such as cylinder, oblong, square, along a line (curved or not), waves, pad (large area with equally distributed filaments, generally with lower density than tufts) or any other suitable shape. This technique can provide further customization to the tufts assembly in that not only the individual tufts can be customized, but also the individual filaments used to form the tufts. In specific embodiments of the invention, the filaments, if independent, can come in a U or V shape, meaning that the filament is composed of a strand folded in its middle portion as shown in view 2350. This filament conditioning does not affect the process previously described.

Figure 24:
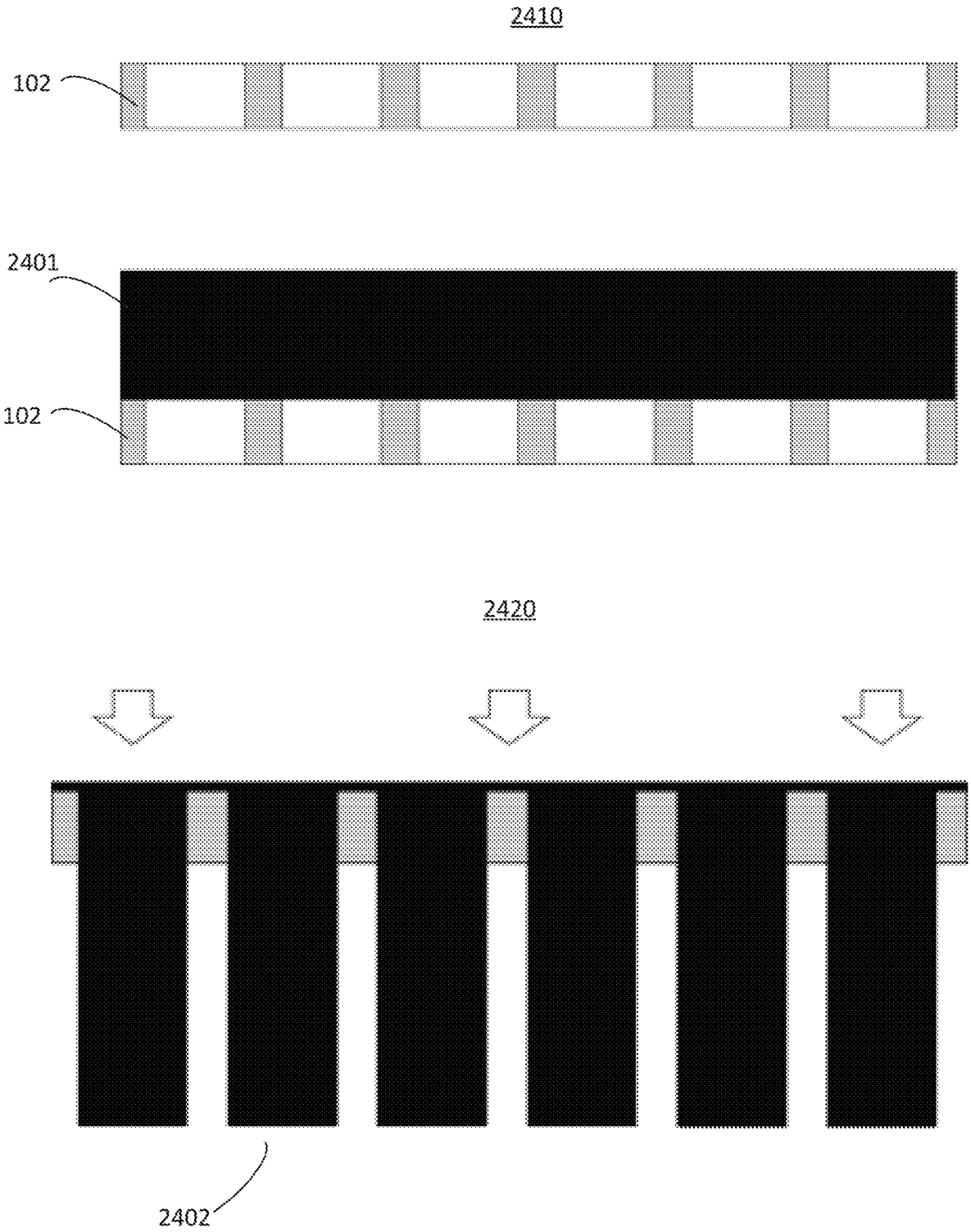
FIG. 24 illustrates an example of the process of filaments extrusion through a grid, in accordance with specific embodiments of the invention disclosed herein.

In specific embodiments of the invention, the support surface (e.g., grid) can be first placed on the support structure. The retention material can be the material of the filaments/tufts themselves as previously described. Then, in specific embodiments of the invention, the retention material can be heated and pressed against the grid, forcing the material through the apertures of the grid and thus forming filaments by extruding them. The filaments can then be cooled to confer them to their definitive and bonded shape. FIG. 24 illustrates an example of the process of filaments extrusion through the grid 102, in accordance with specific embodiments of the invention disclosed herein. As illustrated in view 2410, the material 2401 is applied to the grid 102. As illustrated in view 2420, when pressure is applied in the direction of the arrows, the filaments (e.g., brushing elements) 2402 can be formed. The pressure can be applied by any means such as the heating plate previously described. In that case, the heating plate could both apply heat to transition the material to a molten state and apply the pressure for forming the elements 2402.

The pads/tufts assembly of specific embodiments of the invention may be produced in dimensions that suit an application (tailor made solution) or might be cut once the full strip has been made. Once the pads are assembled, the filaments extremities can be trimmed, polished, formed or any other post processing action that could improve their efficacy in the given way they could operate.

Figure 25:
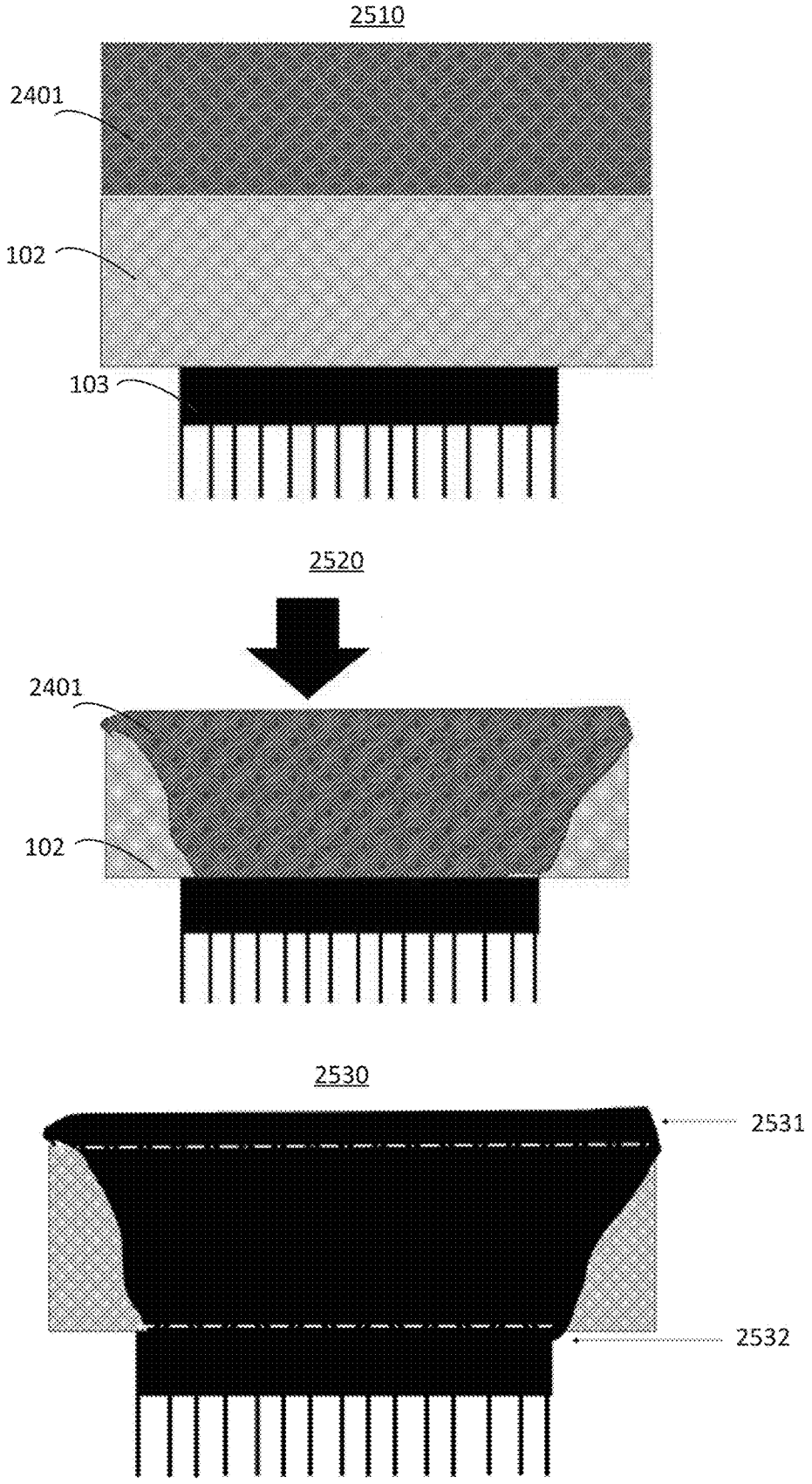
FIG. 25 illustrates an example of the process of adding the retention material, in accordance with specific embodiments disclosed herein.

As mentioned before in this disclosure, in specific embodiments of the invention, the retention material comes from the base of the tufts themselves (e.g., the retention material is the material of the tufts). However, in other embodiments, the retention material does not come from the base of the tufts but is added during an attachment process. For instance, a thermo-sensitive material, able to bond with the material of the tufts can be melted or fused and applied on the permeable support surface. The added material and the base of the tufts can then bond together when heated. They can then solidify to form one solid structure once the temperature decreases. The added material can include but is not limited to polyamide, silicone (e.g., LSR), latex, nitrile, TPE, TPU, thermal glue (e.g., paste, gel or liquid) or any other suitable material. In some embodiments, only the added material is heated. Once it reaches a defined state (e.g., liquid, gel, paste or solid), it can be applied on the permeable surface. The added material can transmit its heat to its surroundings, including the base of the tufts, which can lead to a partial fusing or melting of a defined material thickness thus creating a bond. FIG. 25 illustrates an example of the process of adding the retention material, in accordance with specific embodiments disclosed herein. View 2510 illustrates a retention material, such as material 2401, placed on the support surface 102, which in turn is placed on the base 103 of the tuft. View 2520 illustrates the process of forcing the material 2401 through the support surface when pressure is applied in the direction of the arrow. As explained, the support surface can be permeable to the material (e.g., a grid through which the material can flow in a given state such as a molten state). View 2530 illustrates the formation of a retention area 2531 and a fusion or adhesion area 2532, as a result of this process.

Figure 26:
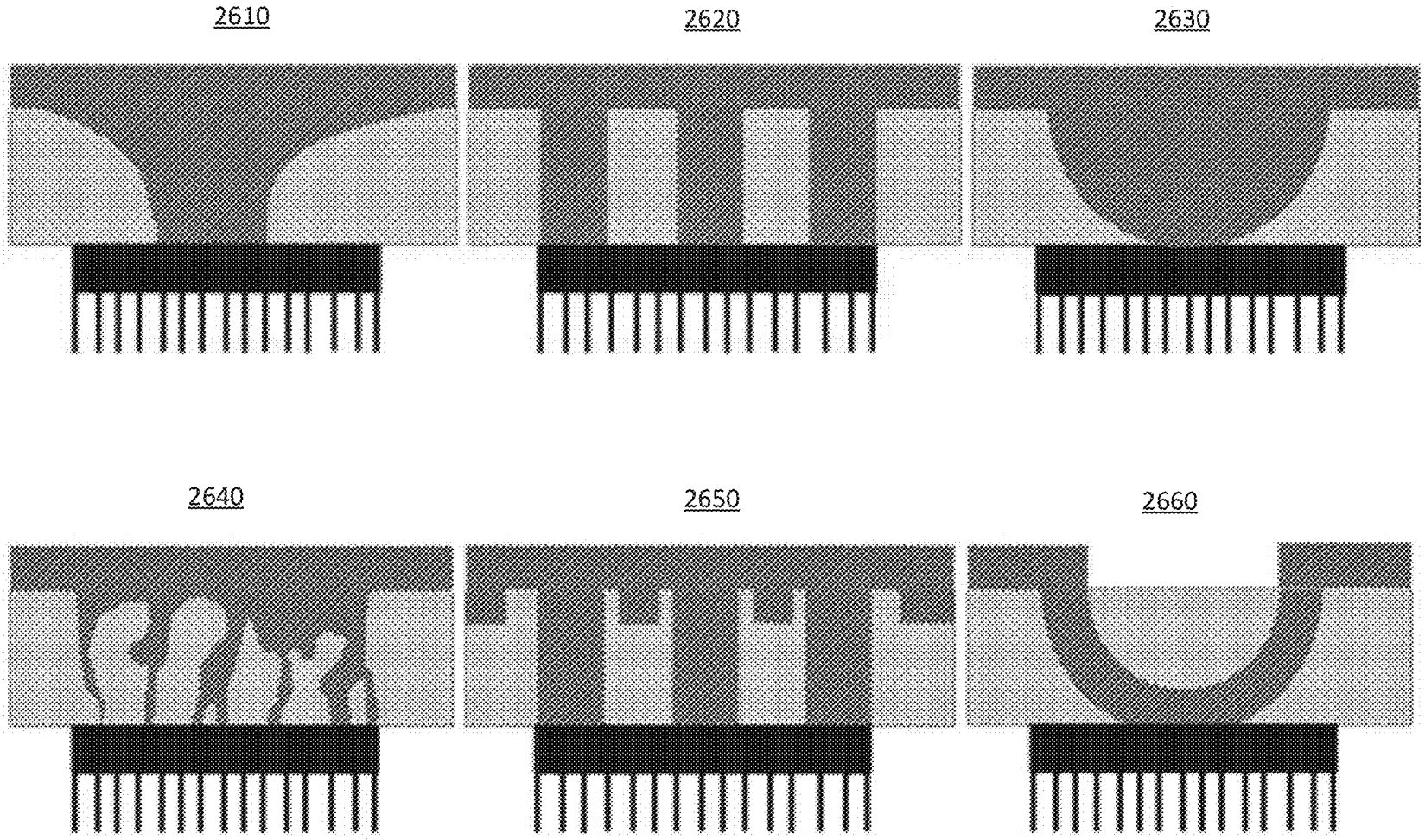
FIG. 26 illustrates examples of different retention patterns that can be created with the process of adding the retention material, in accordance with specific embodiments disclosed herein.

The application of the retention material and the pressure and temperature applied to it can either be homogeneous over the tuft assembly or localized. For instance, with specific applications, temperature and pressure conditions, it is possible to create specific retentive patterns. FIG. 26 illustrates non-limiting examples of different retention patterns 2610, 2620, 2630, 2640, 2650, 2660 that can be created with the process of adding the retention material, in accordance with specific embodiments disclosed herein. These retentive patterns can impact the adhesion of both the tuft and the retention material on the permeable surface.

Figure 27:
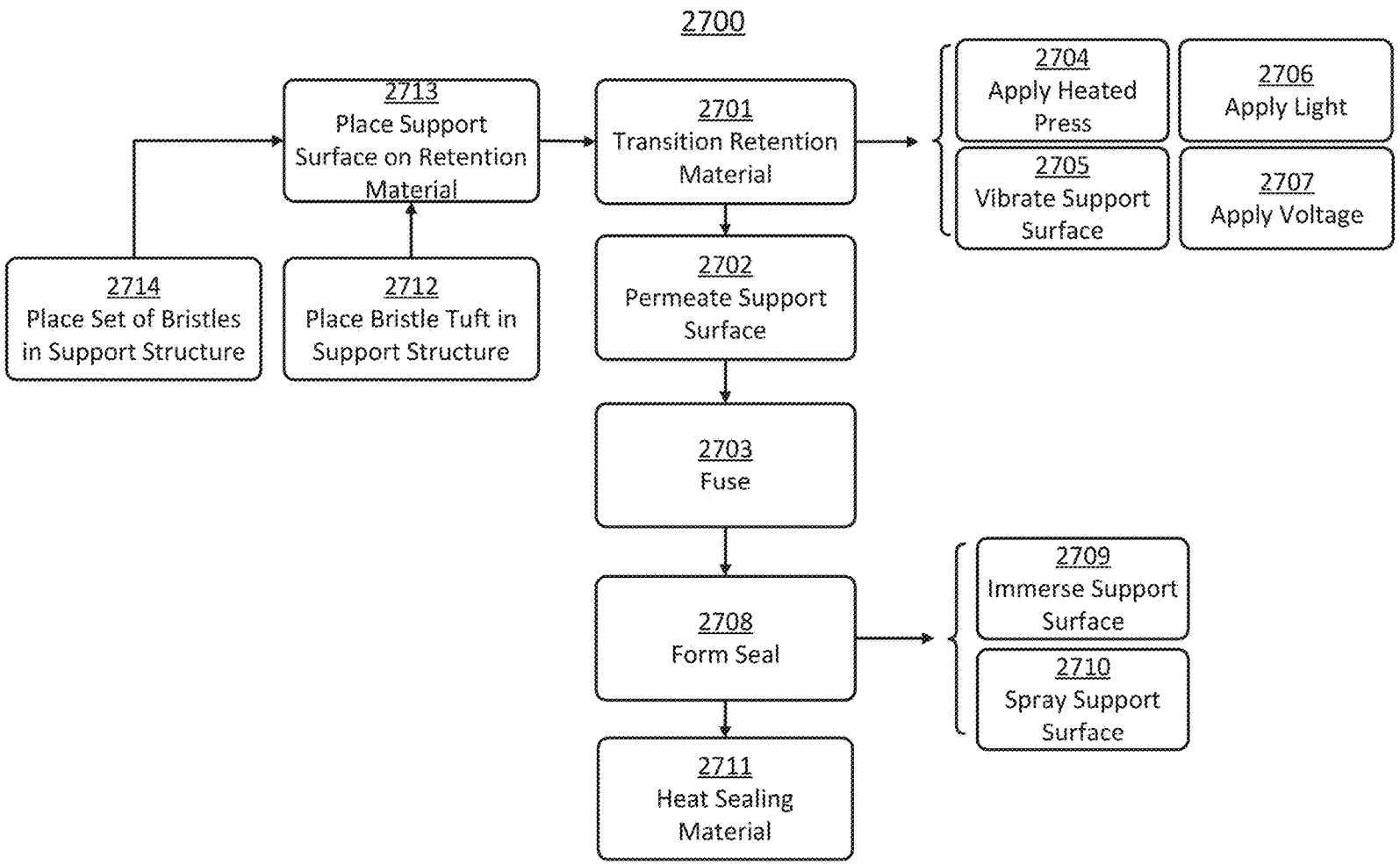
FIG. 27 includes a flowchart for a set of methods, in accordance with specific embodiments of the invention disclosed herein.

FIG. 27 includes a flowchart 2700 for a set of methods in accordance with specific embodiments of the invention disclosed herein. Flowchart 2700 summarizes some of the processes described before in this disclosure, such as the processes to form a tuft assembly. Flowchart 2700 starts with a step 2701 of transitioning a retention material to a molten state. As described before in this disclosure, the retention material can be on an end of a tuft, either by being the same material of the tuft (e.g., the bristle tuft is formed by the retention material itself) or by being an added material. Flowchart 2700 continues with a step 2702 of permeating a support surface with the retention material. This step can be conducted when the retention material is in a molten state. As described before in this disclosure, the support surface can be permeable to the retention material when the retention material is in the molten state. Flowchart 2700 continues with a step 2703 of fusing the retention material into the support surface. In this way, the retention material can be fused into the support surface, and the tuft can be connected to the support surface via the retention material. The retention material can be said to be fused into the support surface when it becomes a unitary structure with the support surface (e.g., molten material permeating support surface solidifies, connecting the two structures together), after the support surface is permeated with molten retention material which has flowed through/extended into the support surface.

Step 2701 of transitioning the retention material to a molten state can include various sub steps as described before in this disclosure. For example, can include a step 2704 of applying a heated press to a side of the support surface while the retention material is in contact with an opposite side of the support surface. Step 2701 can alternatively or in combination include a step 2705 of vibrating the support surface at an ultrasonic frequency while the retention material is in contact with the support surface. Step 2701 can alternatively or in combination include a step 2706 of applying light at an interface of the retention material and the support surface. Step 2701 can alternatively or in combination include a step 2707 of applying a voltage to the support surface.

As explained before in this disclosure, the support surface can have a temperature of fusion that is higher than a temperature of fusion of the retention material, so that when the retention material is heated (for example in step 2701), the retention material is transitioned to a molten state but the support surface is not, under the same conditions. As also explained before in this disclosure, the support surface can be a grid, such as a metallic grid. The support surface can be rigid or deformable, either completely or partially. For example, the support surface can include various zones of different deformation properties, and some zones can be more deformable than others. As used in this disclosure, the term "more deformable" includes the property of being more flexible, requiring weaker constraints to deform, deforming with higher amplitude, and the like. In some embodiments, the support surface can be inelastically deformable. The tuft assembly can be configured to be shaped to an irregular surface of an implement such as an oral care implement (e.g., a mouthpiece shaped to a dental arch, a torus shaped dental care device, an arched tongue scraper, etc.). In some embodiments, the support surface is elastically deformable. The tuft assembly can be configured to deform to transmit a force (e.g., an oral care force) when the force is applied and reform when the force is removed.

Flowchart 2700 includes additional steps such as step 2708 of forming a seal. The seal can be formed using a sealing material and after fusing the retention material with the support surface. The seal can be formed where the retention material is fused with the support surface. Step 2708 of forming the seal can include various sub-steps such as a step 2709 of immersing at least a portion of the support surface in the sealing material, and/or step 2710 of spraying the sealing material onto the support surface. The sealing material can be heated, as indicated by step 2711. The retention material can have a temperature of fusion that is higher than a temperature of fusion of the sealing material, so that the sealing material can be fused at lower temperatures not affecting the retention material state. In specific embodiments of the invention, the sealing material can be hydrophobic, and the seal can be impervious to water. The sealing material can be provided to increase the rigidity of the entirety or one or more portions of the support surface. For example, the support surface can be a grid, such as a metallic grid, and the sealing material can resist deformations of the support surface. In specific embodiments of the invention, the sealing is biocompatible.

Flowchart 2700 also includes a step 2712 of placing the bristle tuft in a support structure. As described before in this disclosure, the retention material can be on an end of the bristle tuft and the retention material can be exposed when placed in the support structure. Flowchart 2700 also includes a step 2713 of placing the support surface on the retention material where the retention material is exposed. Both steps 2712 and 2713 can be performed prior to step 2701 of transitioning the retention material to a molten state. As explained before in this disclosure, this allows the support surface to be in contact with the retention material, so that when the retention material is transitioned to a molten state in step 2701, the support surface can be permeated with it (step 2702) and both structures can be ultimately fused (step 2703). Flowchart 2700 also includes a step 2714 of placing, prior to transitioning the retention material to a molten state, a set of independent bristles in a support structure. As explained before in this disclosure, in this case fusing the retention material into the support surface can additionally fuse the set of independent bristles into the bristle tuft.

Figure 28:
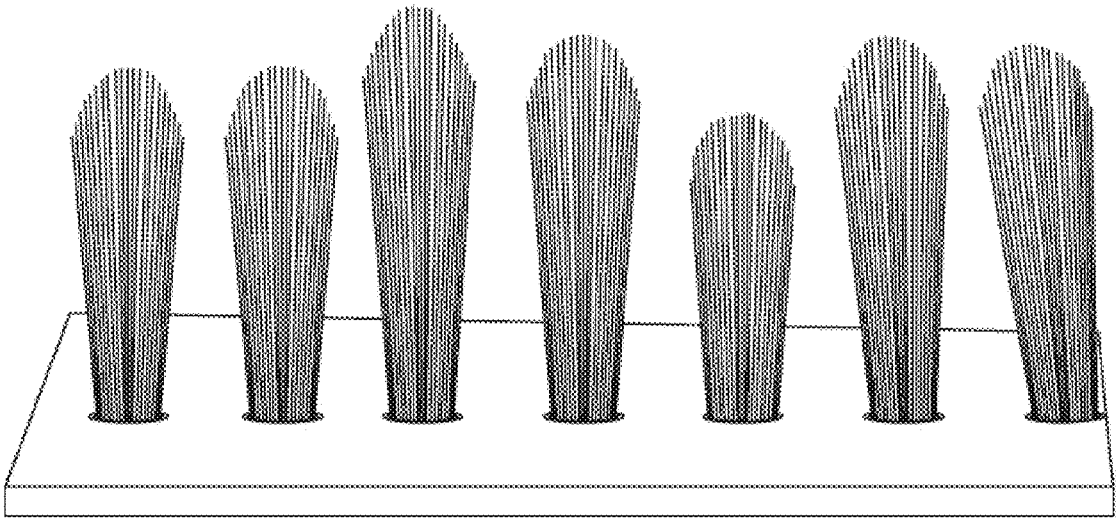
FIG. 28 illustrates a comparison between an assembly obtained with woven methods and one obtained with the process in accordance with specific embodiments of the invention disclosed herein.
Figure 28:
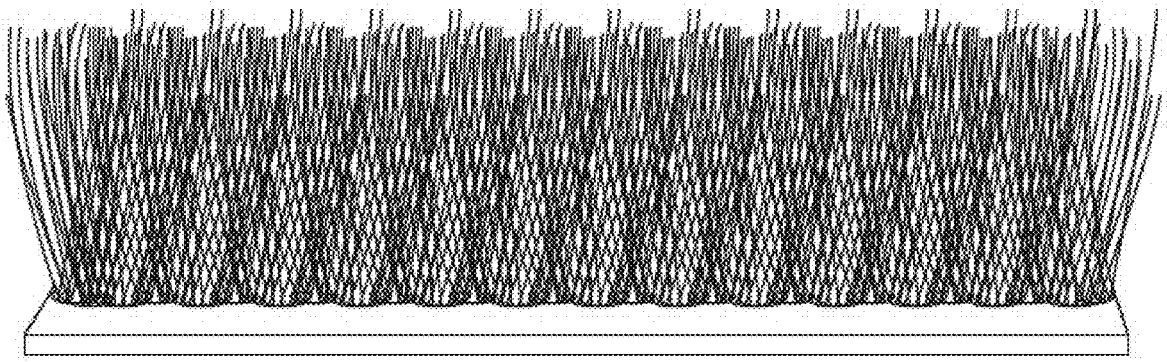

FIG. 28 illustrates a comparison between an assembly obtained with the process as described above (view 2810) and one obtained with woven methods (view 2820). As explained before in this disclosure, specific embodiments of the invention can provide a strong and effective alternative for attaching bristles to a surface compared to known techniques (woven bristles or clamped bristle tufts). The processes described herein can be used to manufacture pads to manage the retention of the tufts, their location as well as their orientation. The pads can provide many other advantages compared to woven pads. For example, its recovery can be better and predictable, the efficiency can be increased, the comfort can be improved, and bacterial proliferation can be contained. Furthermore, the fabrication techniques of specific embodiments of the invention could be applied in an industrial way. In comparison with the traditional ways of attaching filaments to a flexible or rig surface, the technology described herein and the manufacturing processes can improve the ability of the filaments to remain attached to their support while under mechanical stress such as traction, compression, bending, twisting, etc. The ability to place and orient the filaments toward a given direction with more versatility and the ability to manage the filaments characteristics such as material, diameter, length, density, etc., can also be improved. Additionally, the performance of the brushing (e.g., plaque and debris removal capacity) can be better and protection against potential bacterial contamination can be increased.

While the specification has been described in detail with respect to specific embodiments of the invention, it will be appreciated that those skilled in the art, upon attaining an understanding of the foregoing, may readily conceive of alterations to, variations of, and equivalents to these embodiments. Any of the method disclosed herein can be executed by a processor in combination with a computer readable media storing instructions for the methods in combination with the other hardware elements described above. These and other modifications and variations to the present invention may be practiced by those skilled in the art, without departing from the scope of the present invention, which is more particularly set forth in the appended claims.

What is claimed is:

1. A bristle tuft assembly comprising:
a bristle tuft;
a retention material; and
a support surface that is permeable to the retention material when the retention material is in a molten state;
wherein: (i) the retention material is fused into the support surface; and (ii) the bristle tuft is connected to the support surface via the retention material.

2. The bristle tuft assembly of claim 1, wherein:
the retention material is on an end of the bristle tuft.

3. The bristle tuft assembly of claim 1, wherein:
the bristle tuft and the retention material are the same material; and
the support surface has a temperature of fusion that is higher than a temperature of fusion of the retention material.

4. The bristle tuft assembly of claim 1, wherein:
the support surface includes a grid.

5. The bristle tuft assembly of claim 4, wherein:
the grid is metallic.

6. The bristle tuft assembly of claim 1, wherein:
the support surface is deformable.

7. The bristle tuft assembly of claim 1, further comprising:
a first set of zones on the support surface; and
a second set of zones on the support surface;
wherein the first set of zones are more deformable than the second set of zones.

8. The bristle tuft assembly of claim 1, wherein:
the support surface is inelastically deformable; and
the bristle tuft assembly is configured to be shaped to an irregular surface of an oral care implement.

9. The bristle tuft assembly of claim 1, wherein:
the support surface is elastically deformable; and
the bristle tuft assembly is configured to deform to transmit an oral care force when the oral care force is applied and reform when the oral care force is removed.

10. The bristle tuft assembly of claim 1, further comprising:
a sealing material; and
a seal formed by the sealing material where the retention material is fused with the support surface.

11. The bristle tuft assembly of claim 10, wherein:
the retention material has a temperature of fusion that is higher than a temperature of fusion of the sealing material.

12. The bristle tuft assembly of claim 10, wherein:
the sealing material is hydrophobic; and
the seal is impervious to water.

13. The bristle tuft assembly of claim 10, wherein:
the support surface is a grid; and
the sealing material increases a rigidity of at least a portion of the support surface.

14. The bristle tuft assembly of claim 10, wherein:
the support surface is a metallic grid; and
the sealing material resists deformations of the support surface.

15. The bristle tuft assembly of claim 10, wherein:
the sealing material is biocompatible.

16. A method for forming a bristle tuft assembly, the method comprising:
transitioning a retention material to a molten state;
permeating a support surface with the retention material, when the retention material is in the molten state;
fusing the retention material into the support surface; and
whereby: (i) the retention material is fused into the support surface; and (ii) a bristle tuft is connected to the support surface via the retention material.

17. The method of claim 16, wherein transitioning the retention material to the molten state comprises:
applying a heated press to a side of the support surface while the retention material is in contact with an opposite side of the support surface.

18. The method of claim 16, wherein transitioning the retention material to the molten state comprises:
vibrating the support surface at an ultrasonic frequency while the retention material is in contact with the support surface.

19. The method of claim 16, wherein transitioning the retention material to the molten state comprises:

applying light at an interface of the retention material and the support surface.

20. The method of claim 16, wherein transitioning the retention material to the molten state comprises:

applying a voltage to the support surface.

21. The method of claim 16, wherein:

the bristle tuft is formed by the retention material; and the support surface has a temperature of fusion that is higher than a temperature of fusion of the retention material.

22. The method of claim 16, further comprising:

forming, using a sealing material and after fusing the retention material with the support surface, a seal where the retention material is fused into the support surface.

23. The method of claim 22, wherein forming the seal comprises:

immersing at least a portion of the support surface in the sealing material.

24. The method of claim 22, wherein forming the seal comprises:

spraying the sealing material onto the support surface.

25. The method of claim 22, further comprising:

heating the sealing material;

wherein the retention material has a temperature of fusion that is higher than a temperature of fusion of the sealing material.

26. The method of claim 16, further comprising, prior to transitioning the retention material to a molten state:

placing, the bristle tuft in a support structure, wherein the retention material is on an end of the bristle tuft and the retention material is exposed; and placing the support surface on the retention material where the retention material is exposed.

27. A bristle tuft assembly comprising:

a bristle tuft;

a retention material on an end of the bristle tuft; and a support surface that is permeable to the retention material when the retention material is in a molten state;

wherein the retention material is fused into the support surface.

28. The bristle tuft assembly of claim 27, wherein:

the bristle tuft and the retention material are the same material; and the support surface has a temperature of fusion that is higher than a temperature of fusion of the retention material.

29. The bristle tuft assembly of claim 27, further comprising:

a sealing material; and a seal formed by the sealing material where the retention material is fused into the support surface.

30. The bristle tuft assembly of claim 29, wherein:

the retention material has a temperature of fusion that is higher than a temperature of fusion of the sealing material.

* * * * *